US010433075B2

(12) United States Patent
Crow et al.

(10) Patent No.: US 10,433,075 B2
(45) Date of Patent: Oct. 1, 2019

(54) LOW LATENCY AUDIO ENHANCEMENT

(71) Applicant: Whisper.ai Inc., San Francisco, CA (US)

(72) Inventors: Dwight Crow, San Francisco, CA (US); Shlomo Zippel, San Francisco, CA (US); Andrew Song, San Francisco, CA (US); Emmett McQuinn, San Francisco, CA (US); Zachary Rich, San Francisco, CA (US)

(73) Assignee: Whisper.ai, Inc., San Francisco, CA (US)

( * ) Notice: Subject to any disclaimer, the term of this patent is extended or adjusted under 35 U.S.C. 154(b) by 0 days.

(21) Appl. No.: 16/129,792

(22) Filed: Sep. 12, 2018

(65) Prior Publication Data

US 2019/0082276 A1 Mar. 14, 2019

Related U.S. Application Data

(60) Provisional application No. 62/557,468, filed on Sep. 12, 2017.

(51) Int. Cl.
*H04R 25/00* (2006.01)
*G10L 25/78* (2013.01)

(52) U.S. Cl.
CPC ..... *H04R 25/505* (2013.01); *G10L 25/78* (2013.01); *H04R 25/50* (2013.01); *H04R 25/554* (2013.01); *H04R 2225/39* (2013.01); *H04R 2225/41* (2013.01); *H04R 2225/51* (2013.01); *H04R 2225/55* (2013.01)

(58) Field of Classification Search
CPC ..... H04R 25/505; H04R 25/554; H04R 2225/51; H04R 2225/43; H04R 2225/41; H04R 25/558; G10L 25/78; H03G 1/02
See application file for complete search history.

(56) References Cited

U.S. PATENT DOCUMENTS

| | | | | |
|---|---|---|---|---|
| 3,750,024 | A * | 7/1973 | Dunn | H04B 1/66 704/212 |
| 2009/0043577 | A1* | 2/2009 | Godavarti | G10L 21/02 704/233 |
| 2009/0190774 | A1* | 7/2009 | Wang | G10L 21/028 381/92 |
| 2011/0007907 | A1* | 1/2011 | Park | G10K 11/178 381/71.8 |
| 2011/0237295 | A1* | 9/2011 | Bartkowiak | H04R 25/505 455/556.1 |
| 2015/0289065 | A1* | 10/2015 | Jensen | H04R 25/552 381/315 |
| 2016/0360326 | A1* | 12/2016 | Bergmann | H04R 25/554 |
| 2018/0014130 | A1 | 1/2018 | Lunner et al. | |
| 2018/0054683 | A1* | 2/2018 | Pedersen | H04R 25/505 |

OTHER PUBLICATIONS

Weile et al., "The VeloxTM Platform," Tech Paper, 2016, https://www.oticon.com/-/media/oticon-us/main/download-center/white-papers/15555-9940-velox-whitepaper.pdf, 8 pages.
U.S. Appl. No. 16/264,297, filed Jan. 31, 2019.

* cited by examiner

*Primary Examiner* — Sunita Joshi
(74) *Attorney, Agent, or Firm* — Mauriel Kapouytian Woods LLP; Michael Mauriel

(57) ABSTRACT

A hearing aid system and method is disclosed. Disclosed embodiments provide for low latency enhanced audio using a hearing aid earpiece and an auxiliary processing unit wirelessly connected to the earpiece. These and other embodiments are disclosed herein.

37 Claims, 5 Drawing Sheets

LOW LATENCY AUDIO ENHANCEMENT

CROSS-REFERENCE TO RELATED APPLICATIONS

This application claims the benefit of U.S. Provisional Application No. 62/557,468 filed 12 Sep. 2017. This application is also related to U.S. Provisional Application No. 62/576,373 filed 24 Oct. 2017. The contents of both of these applications are incorporated by reference herein.

TECHNICAL FIELD

This invention relates generally to the audio field, and more specifically to a new and useful method and system for low latency audio enhancement.

DESCRIPTION OF THE PREFERRED EMBODIMENTS

Figure 1:
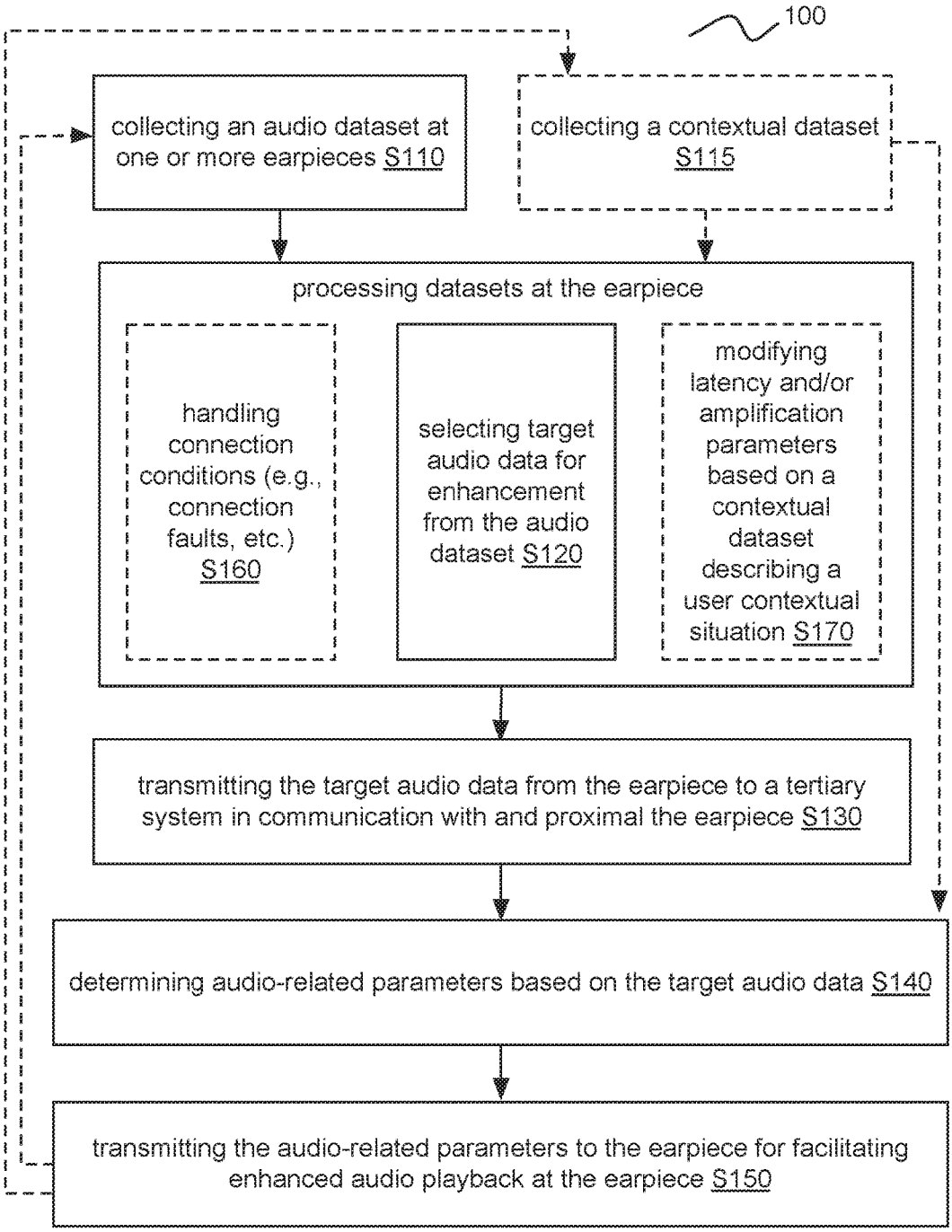
FIG. 1 is a processing flow diagram illustrating a method in accordance with an embodiment of the invention.

The following description of the preferred embodiments of the invention is not intended to limit the invention to these preferred embodiments, but rather to enable any person skilled in the art to make and use this invention.

1. Overview

Hearing aid systems have traditionally conducted real-time audio processing tasks using processing resources located in the earpiece. Because small hearing aids are more comfortable and desirable for the user, relying only on processing and battery resources located in an earpiece limits the amount of processing power available for delivering enhanced-quality low latency audio at the user's ear. For example, one ear-worn system known in the art is the Oticon Opn™. Oticon advertises that the Opn is powered by the Velox™ platform chip. Oticon advertises that the Velox™ chip is capable of performing 1,200 million operations per second (MOPS). See Oticon's Tech Paper 2016: "The Velox™ Platform" by Julie Neel Welle and Rasmus Bach (available at www.oticon.com/support/downloads).

Of course, a device not constrained by the size requirements of an earpiece could provide significantly greater processing power. However, the practical requirement for low latency audio processing in a hearing aid has discouraged using processing resources and battery resources remote from the earpiece. A wired connection from hearing aid earpieces to a larger co-processing/auxiliary device supporting low latency audio enhancement is not generally desirable to users and can impede mobility. Although wireless connections to hearing aid earpieces have been used for other purposes (e.g., allowing the earpiece to receive Bluetooth audio streamed from a phone, television, or other media playback device), a wireless connection for purposes of off-loading low latency audio enhancement processing needs from an earpiece to a larger companion device has, to date, been believed to be impractical due to the challenges of delivering, through such a wireless connection, the low latency and reliability necessary for delivering acceptable real-time audio processing. Moreover, the undesirability of fast battery drain at the earpiece combined with the power requirements of traditional wireless transmission impose further challenges for implementing systems that send audio wirelessly from an earpiece to another, larger device for enhanced processing.

Embodiments of the invention address these challenges and provide a low-latency, power-optimized wireless hearing aid system in which target audio data obtained at an earpiece is efficiently transmitted for enhancement processing at an auxiliary processing device (e.g., a tertiary device or other device—which might, in some sense, be thought of as a coprocessing device), the auxiliary processing device providing enhanced processing power not available at the earpiece. In particular embodiments, when audio is identified for sending to the auxiliary processing device for enhancement, it—or data representing it—is sent wirelessly to the auxiliary processing device. The auxiliary processing device analyzes the received data (possibly in conjunction with other relevant data such as context data and/or known user preference data) and determines filter parameters (e.g., coefficients) for optimally enhancing the audio. Preferably, rather than sending back enhanced audio from the auxiliary device over the wireless link to the earpiece, an embodiment of the invention sends audio filter parameters back to the earpiece. Then, processing resources at the earpiece apply the received filter parameters to a filter at the earpiece to filter the target audio and produce enhanced audio played by the earpiece for the user. These and other techniques allow the earpiece to effectively leverage the processing power of a larger device to which it is wirelessly connected to better enhance audio received at the earpiece and play it for the user on a real time basis (i.e., without delay that is noticeable by typical users). In some embodiments, the additional leveraged processing power capacity accessible at the wirelessly connected auxiliary processing unit is at least ten times greater than provided at current earpieces such as the above referenced Oticon device. In some embodiments, it is at least 100 times greater.

In some embodiments, trigger conditions are determined based on one or more detected audio parameters and/or other parameters. When a trigger condition is determined to have occurred, data representative of target audio is wirelessly sent to the auxiliary processing device to be processed for determining parameters for enhancement. In one embodiment, while the trigger condition is in effect, target audio (or derived data representing target audio) is sent at intervals of 40 milliseconds (ms) or less. In another embodiment, it is sent at intervals of toms or less. In another embodiment, it is sent at intervals of less than 4 ms.

In some embodiments, audio data sent wirelessly from the earpiece to the auxiliary unit is sent in batches of 1 kilobyte (kb) or less. In some embodiments, it is sent in batches of 512 bytes or less. In some embodiments, it is sent in batches of 256 bytes or less. In some embodiments, it is sent in batches of 128 bytes or less. In some embodiments, it is sent in batches of 32 bytes or less. In some embodiments, filter parameter data sent wirelessly from the auxiliary unit is sent in batches of 1 kilobyte (kb) or less. In some embodiments, it is sent in batches of 512 bytes or less. In some embodiments, it is sent in batches of 256 bytes or less. In some embodiments, it is sent in batches of 128 bytes or less. In some embodiments, it is sent in batches of 32 bytes or less.

FIG. 1 illustrates a method/processing 100 in accordance with one embodiment of the invention. In method 100, Block S110 collects an audio dataset at an earpiece; Block S120 selects, at the earpiece, target audio data for enhancement from the audio dataset; Block S130 wirelessly transmits the target audio data from the earpiece to a tertiary system in communication with and proximal the earpiece. Block S140 determines audio-related parameters based on the target audio data. Block S150 wirelessly transmits the audio-related parameters to the earpiece for facilitating enhanced audio playback at the earpiece. Block S115, included in some embodiments, collects a contextual dataset for describing a user's contextual situation. Block S170 uses the contextual data from Block S115 and modifies latency and/or amplification parameters based on the contextual dataset. Block S160 handles connection conditions (e.g., connection faults leading to dropped packets, etc.) between an earpiece and a tertiary system (and/or other suitable audio enhancement components).

In a specific example, method 100 includes collecting an audio dataset at a set of microphones (e.g., two microphones, etc.) of an earpiece worn proximal a temporal bone of a user; selecting target audio data (e.g., a 4 ms buffered audio sample) for enhancement from the audio dataset (e.g., based on identified audio activity associated with the audio dataset; based on a contextual dataset including motion data, location data, temporal data, and/or other suitable data; etc.), such as through applying a target audio selection model; transmitting the target audio data from the earpiece to a tertiary system (e.g., through a wireless communication channel); processing the target audio data at the tertiary system to determine audio characteristics of the target audio data (e.g., voice characteristics, background noise characteristics, difficulty of separation between voice and background noise, comparisons between target audio data and historical target audio data, etc.); determining audio-related parameters (e.g., time-bounded filters; update rates for filters; modified audio in relation to bit rate, sampling rate, resolution, and/or other suitable parameters; etc.) based on audio characteristics and/or other suitable data, such as through using an audio parameter machine learning model; transmitting the audio-related parameters to the earpiece from the tertiary system (e.g., through the wireless communication channel); and providing enhanced audio playback at the earpiece based on the audio-related parameters (e.g., applying local filtering based on the received filters; playing back the enhanced audio; etc.).

Figure 2:
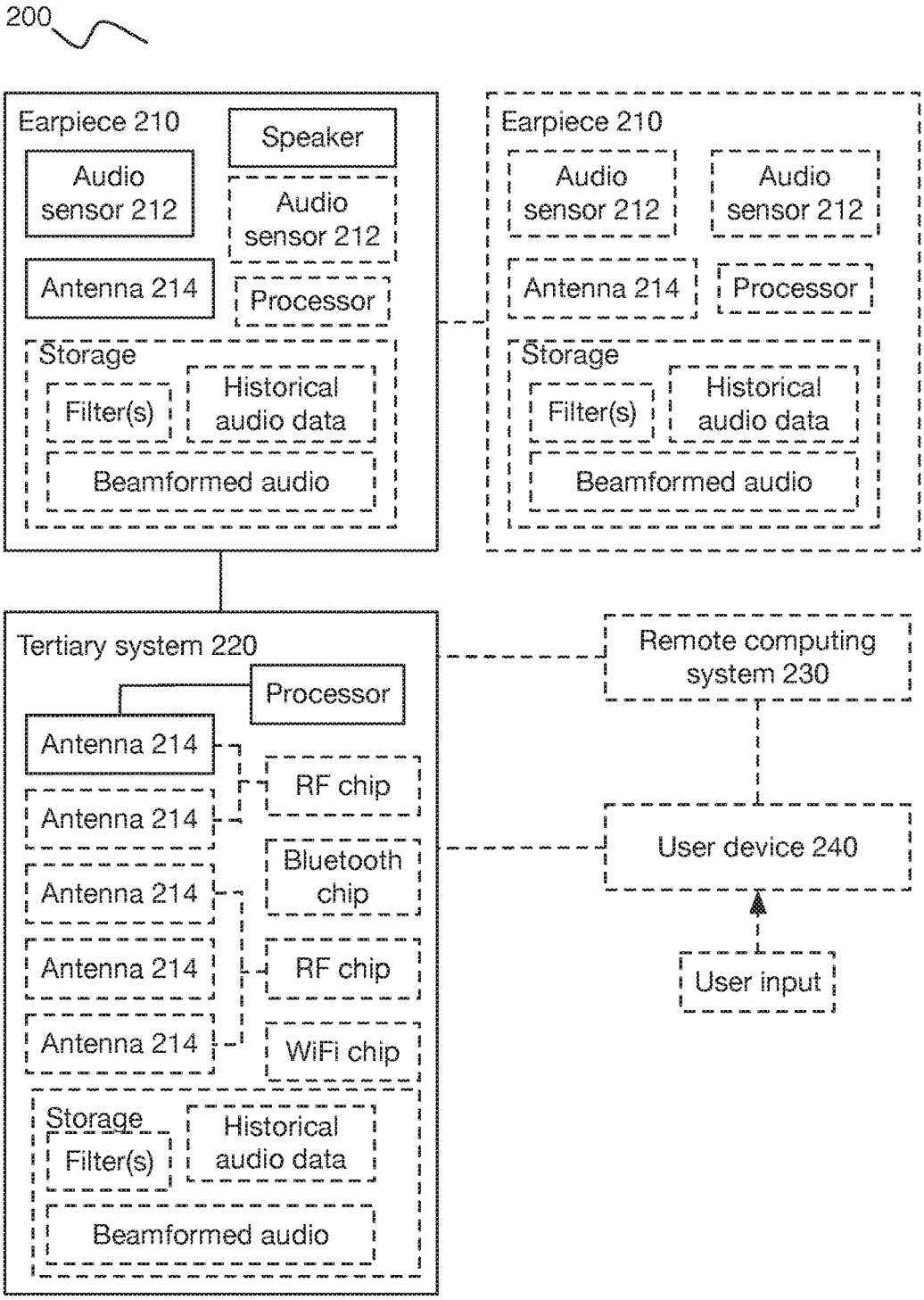
FIG. 2 is a high-level schematic diagram illustrating a system in accordance with embodiments of the invention.

As shown in FIG. 2, embodiments of a system 200 can include: a set of one or more earpieces 210 and tertiary system 220. Additionally or alternatively, the system 200 can include a remote computing system 230, user device 240, and/or other suitable components. Thus, whether an auxiliary unit such as tertiary device 220 is a secondary, tertiary, or other additional component of system 200 can vary in different embodiments. The term "tertiary system" is used herein as a convenient label, but herein refers generally to any auxiliary device configured to perform the processing and earpiece communications described herein. It does not specifically refer to a "third" device. Some embodiments of the present invention may involve at least two devices and others at least three.

In a specific example, an embodiment of the system 200 includes one or more earpieces 210, each having multiple (e.g., 2, more than 2, 4, etc.) audio sensors 212 (e.g., microphones, transducers, piezoelectric sensors, etc.) configured to receive audio data, wherein the earpiece is configured to communicate with a tertiary system. The system 200 can further include a remote computing system 230 and/or a user device 240 configured to communicate with one or both of the earpieces 210 and tertiary system 220.

One or more instances and/or portions of the method 100 and/or processes described herein can be performed asynchronously (e.g., sequentially), concurrently (e.g., determining audio-related parameters for a first set of target audio data at an auxiliary processing device, e.g., tertiary system 220, while selecting a second set of target audio data at the earpiece for enhancement in temporal relation to a trigger condition, e.g., a sampling of an audio dataset at microphones of the earpiece; detection of audio activity satisfying an audio condition; etc.), and/or in any other suitable order at any suitable time and frequency by and/or using one or more instances of the system 200, elements, and/or entities described herein.

Additionally or alternatively, data described herein (e.g., audio data, audio-related parameters, audio-related models, contextual data, etc.) can be associated with any suitable temporal indicators (e.g., seconds, minutes, hours, days, weeks, etc.) including one or more: temporal indicators indicating when the data was collected, determined, transmitted, received, and/or otherwise processed; temporal indicators providing context to content described by the data, such as temporal indicators indicating the update rate for filters transmitted to the earpiece; changes in temporal indicators (e.g., latency between sampling of audio data and playback of an enhanced form of the audio data; data over time; change in data; data patterns; data trends; data extrapolation and/or other prediction; etc.); and/or any other suitable indicators related to time. However, the method 100 and/or system 200 can be configured in any suitable manner.

2. Benefits

The method and system described herein can confer several benefits over conventional methods and systems.

In some embodiments, the method 100 and/or system 200 enhances audio playback at a hearing aid system. This is achieved through any or all of: removing or reducing audio corresponding to a determined low-priority sound source (e.g., low frequencies, non-voice frequencies, low amplitude, etc.), maintaining or amplifying audio corresponding to a determined high-priority sound source (e.g., high amplitude), applying one or more beamforming methods for transmitting signals between components of the system, and/or through other suitable processes or system components.

Some embodiments of the method 100 and/or system 200 can function to minimize battery power consumption. This can be achieved through any or all of: optimizing transmission of updates to local filters at the earpiece to save battery life while maintaining filter accuracy; adjusting (e.g., decreasing) a frequency of transmission of updates to local filters at the earpiece; storing (e.g., caching) historical audio data or filters (e.g., previously recorded raw audio data, previously processed audio data, previous filters, previous filter parameters, a characterization of complicated audio environments, etc.) in any or all of: an earpiece, tertiary device, and remote storage; shifting compute- and/or power-intensive processing (e.g., audio-related parameter value determination, filter determination, etc.) to a secondary system (e.g., auxiliary processing unit, tertiary system, remote computing system, etc.); connecting to the secondary system via a low-power data connection (e.g., a short range connection, a wired connection, etc.) or relaying the data between the secondary system and the earpiece via a low-power connection through a gateway colocalized with the earpiece; decreasing requisite processing power by preprocessing the analyzed acoustic signals (e.g., by acoustically beamforming the audio signals); increasing data transmission reliability (e.g., using RF beamforming, etc.); and/or through any other suitable process or system component.

Additionally or alternatively, embodiments of the method 100 and/or system 200 can function to improve reliability. This can be achieved through any or all of: leveraging locally stored filters at an earpiece to improve tolerance to connection faults between the earpiece and a tertiary system; adjusting a parameter of signal transmission (e.g., increasing frequency of transmission, decreasing bit depth of signal, repeating transmission of a signal, etc.) between the earpiece and tertiary system; and/or through any suitable process or system component.

3. Method 100

3.1 Collecting an Audio Dataset at an Earpiece S110

Referring back to FIG. 1, Block S110 collects an audio dataset at an earpiece, which can function to receive a dataset including audio data to enhance. Audio datasets are preferably sampled at one or more microphones (and/or other suitable types of audio sensors) of one or more earpieces, but can be sampled at any suitable components (e.g., auxiliary processing units—e.g., secondary or tertiary systems—remote microphones, telecoils, earpieces associated with other users, user mobile devices such as smartphones, etc.) and at any suitable sampling rate (e.g., fixed sampling rate; dynamically modified sampling rate based on contextual datasets, audio-related parameters determined by the auxiliary processing units, other suitable data; etc.).

In an embodiment, Block S110 collects a plurality of audio datasets (e.g., using a plurality of microphones; using a directional microphone configuration; using multiple ports of a microphone in a directional microphone configuration, etc.) at one or more earpieces, which can function to collect multiple audio datasets associated with an overlapping temporal indicator (e.g., sampled during the same time period) for improving enhancement of audio corresponding to the temporal indicator. Processing the plurality of audio datasets (e.g., combining audio datasets; determining 3D spatial estimation based on the audio datasets; filtering and/or otherwise processing audio based on the plurality of audio datasets; etc.) can be performed with any suitable distribution of processing functionality across the one or more earpieces and the one or more tertiary systems (e.g., using the earpiece to select a segment of audio data from one or more of the plurality of audio datasets to transmit to the tertiary system; using the tertiary system to determine filters for the earpiece to apply based on the audio data from the plurality of datasets; etc.). In another example, audio datasets collected at non-earpiece components can be transmitted to an earpiece, tertiary system, and/or other suitable component for processing (e.g., processing in combination with audio datasets collected at the earpiece for selection of target audio data to transmit to the tertiary system; for transmission along with the earpiece audio data to the tertiary system to facilitate improved accuracy in determining audio-related parameters; etc.). Collected audio datasets can be processed to select target audio data, where earpieces, tertiary systems, and/or other suitable components can perform target audio selection, determine target audio selection parameters (e.g., determining and/or applying target audio selection criteria at the tertiary system; transmitting target audio selection criteria from the tertiary system to the earpiece; etc.), coordinate target audio selection between audio sources (e.g., between earpieces, remote microphones, etc.), and/or other suitable processes associated with collecting audio datasets and/or selecting target audio data. However, collecting and/or processing multiple audio datasets can be performed in any suitable manner.

In another embodiment, Block S110 selects a subset of audio sensors (e.g., microphones) of a set of audio sensors to collect audio data, such as based on one or more of: audio datasets (e.g., determining a lack of voice activity and a lack of background noise based on a plurality of audio data corresponding to a set of microphones, and ceasing sampling for a subset of the microphones based on the determination, which can facilitate improved battery life; historical audio datasets; etc.), contextual datasets (e.g. selecting a subset of microphones to sample audio data as opposed to the full set of microphones, based on a state of charge of system components; increasing the number of microphones sampling audio data based on using supplementary sensors to detect a situation with a presence of voice activity and high background noise; dynamically selecting microphones based on audio characteristics of the collected audio data and on the directionality of the microphones; dynamically selecting microphones based on an actual or predicted location of the sound source; selecting microphones based on historical data (e.g., audio data, contextual data, etc.); etc.); quality and/or strength of audio data received at the audio sensors (e.g., select audio sensor which receives highest signal strength; select audio sensor which is least obstructed from the sound source and/or tertiary system; etc.) and/or other suitable data. However, selecting audio sensors for data collection can be performed in any suitable manner.

In the same or another embodiment, Block S110 selects a subset of earpieces to collect audio data based on any of the data described above or any other suitable data.

Block S110 and/or other suitable portions of the method 100 can include data pre-processing (e.g., for the collected audio data, contextual data, etc.). For example, the pre-processed data can be: played back to the user; used to determine updated filters or audio-related parameters (e.g., by the tertiary system) for subsequent user playback; or otherwise used. Pre-processing can include any one or more of: extracting features (e.g., audio features for use in selective audio selection, in audio-related parameters determination; contextual features extracted from contextual dataset; an audio score; etc.), performing pattern recognition on data (e.g., in classifying contextual situations related to collected audio data; etc.), fusing data from multiple sources (e.g., multiple audio sensors), associating data from multiple sources (e.g., associating first audio data with second audio data based on a shared temporal indicator), associating audio data with contextual data (e.g., based on a shared temporal indicator; etc.), combining values (e.g., averaging values, etc.), compression, conversion (e.g., digital-to-analog conversion, analog-to-digital conversion, time domain to frequency domain conversion, frequency domain to time domain conversion, etc.), wave modulation, normalization, updating, ranking, weighting, validating, filtering (e.g., for baseline correction, data cropping, etc.), noise reduction, smoothing, filling (e.g., gap filling), aligning, model fitting, binning, windowing, clipping, transformations (e.g., Fourier transformations such as fast Fourier transformations, etc.); mathematical operations, clustering, and/or other suitable processing operations.

In one embodiment, the method includes pre-processing the sampled audio data (e.g., all sampled audio data, the audio data selected in S120, etc.). For example, pre-processing the sampled audio data may include acoustically beamforming the audio data sampled by one or more of the multiple microphones. Acoustically beamforming the audio data can include applying one or more of the following enhancements to the audio data: fixed beamforming, adaptive beamforming (e.g., using a minimum variance distortionless response (MVDR) beamformer, a generalized sidelobe canceler (GSC), etc.), multi-channel Wiener filtering (MWF), computational auditory scene analysis, or any other suitable acoustic beamforming technique. In another embodiment without use of acoustic beamforming, blind source separation (BSS) is used. In another example, pre-processing the sampled audio data may include processing the sampled audio data using a predetermined set of audio-related parameters (e.g., applying a filter), wherein the predetermined audio-related parameters can be a static set of values, be determined from a prior set of audio signals (e.g., sampled by the instantaneous earpiece or a different earpiece), or otherwise determined. However, the sampled audio data can be otherwise determined.

In some embodiments, the method may include applying a plurality of the embodiments above to pre-process the audio data, e.g., wherein an output of a first embodiment is sent to the tertiary system and an output of a second embodiment is played back to the user. In another example, the method may include applying or more embodiments to pre-process the audio data, and sending an output to one or more earpiece speakers (e.g., for user playback) and the tertiary system. Additionally or alternatively, pre-processing data and/or collecting audio datasets can be performed in any suitable manner.

3.2 Collecting a Contextual Dataset S115

In one embodiment, method 100 includes Block S115, which collects a contextual dataset. Collecting a contextual dataset can function to collect data to improve performance of one or more portions of the method 100 (e.g., leveraging contextual data to select appropriate target audio data to transmit to the tertiary system for subsequent processing; using contextual data to improve determination of audio-related parameters for corresponding audio enhancement; using contextual data to determine the locally stored filters to apply at the earpiece during periods where a communication channel between an earpiece and a tertiary system is faulty; etc.). Contextual datasets are preferably indicative of the contextual environment associated with one or more audio datasets, but can additionally or alternatively describe any suitable related aspects. Contextual datasets can include any one or more of: supplementary sensor data (e.g., sampled at supplementary sensors of an earpiece; a user mobile device; and/or other suitable components; motion data; location data; communication signal data; etc.), and user data (e.g., indicative of user information describing one or more characteristics of one or more users and/or associated devices; datasets describing user interactions with interfaces of earpieces and/or tertiary systems; datasets describing devices in communication with and/or otherwise connected to the earpiece, tertiary system, remote computing system, user device, and/or other components; user inputs received at an earpiece, tertiary system, user device, remote computing system; etc.). In an example, the method 100 can include collecting an accelerometer dataset sampled at an accelerometer sensor set (e.g., of the earpiece, of a tertiary system, etc.) during a time period; and selecting target audio data from an audio dataset (e.g., at an earpiece, at a tertiary system, etc.) sampled during the time period based on the accelerometer dataset. In another example, the method 100 can include transmitting target audio data and selected accelerometer data from the accelerometer dataset to the tertiary system (e.g., from an earpiece, etc.) for audio-related parameter determination. Alternatively, collected contextual data can be exclusively processed at the earpiece (e.g., where contextual data is not transmitted to the tertiary system; etc.), such as for selecting target audio data for facilitating escalation. In another example, the method 100 can include collecting a contextual dataset at a supplementary sensor of the earpiece; and detecting, at the earpiece, whether the earpiece is being worn by the user based on the contextual dataset. In yet another example, the method 100 can include receiving a user input (e.g., at an earpiece, at a button of the tertiary system, at an application executing on a user device, etc.), which can be used in determining one or more filter parameters.

Collecting a contextual dataset preferably includes collecting a contextual dataset associated with a time period (and/or other suitable temporal indicated) overlapping with a time period associated with a collected audio dataset (e.g., where audio data from the audio dataset can be selectively targeted and/or otherwise processed based on the contextual dataset describing the situational environment related to the audio; etc.), but contextual datasets can alternatively be time independent (e.g., a contextual dataset including a device type dataset describing the devices in communication with the earpiece, tertiary system, and/or related components; etc.). Additionally or alternatively, collecting a contextual dataset can be performed in any suitable temporal relation to collecting audio datasets, and/or can be performed at any suitable time and frequency. However, contextual datasets can be collected and used in any suitable manner.

3.3 Selecting Target Audio Data for Enhancement

Block S120 recites: selecting target audio data for enhancement from the audio dataset, which can function to select audio data suitable for facilitating audio-related parameter determination for enhancing audio (e.g., from the target audio data; from the audio dataset from which the target audio data was selected; etc.). Additionally or alternatively, selecting target audio data can function to improve battery life of the audio system (e.g., through optimizing the amount and types of audio data to be transmitted between an earpiece and a tertiary system; etc.). Selecting target audio data can include selecting any one or more of: duration (e.g., length of audio segment), content (e.g., the audio included in the audio segment), audio data types (e.g., selecting audio data from select microphones, etc.), amount of data, contextual data associated with the audio data, and/or any other suitable aspects. In a specific example, selecting target audio data can include selecting sample rate, bit depth, compression techniques, and/or other suitable audio-related parameters. Any suitable type and amount of audio data (e.g., segments of any suitable duration and characteristics; etc.) can be selected for transmission to a tertiary system. In an example, audio data associated with a plurality of sources (e.g., a plurality of microphones) can be selected. In a specific example, Block S120 can include selecting and transmitting first and second audio data respectively corresponding to a first and a second microphone, where the first and the second audio data are associated with a shared temporal indicator. In another specific example, Block S120 can include selecting and transmitting different audio data corresponding to different microphones (e.g., associated with different directions; etc.) and different temporal indicators (e.g., first audio data corresponding to a first microphone and a first time period; second audio data corresponding to a second microphone and a second time period; etc.). Alternatively, audio data from a single source can be selected.

Selecting target audio data can be based on one or more of: audio datasets (e.g., audio features extracted from the audio datasets, such as Mel Frequency Cepstral Coefficients; reference audio datasets such as historic audio datasets used in training a target audio selection model for recognizing patterns in current audio datasets; etc.), contextual datasets (e.g., using contextual data to classify the contextual situation and to select a representative segment of target audio data; using the contextual data to evaluate the importance of the audio; etc.), temporal indicators (e.g., selecting segments of target audio data corresponding to the starts of recurring time intervals; etc.), target parameters (e.g., target latency, battery consumption, audio resolution, bitrate, signal-to-noise ratio, etc.), and/or any other suitable criteria.

In some embodiments, Block S120 includes applying (e.g., generating, training, storing, retrieving, executing, etc.) a target audio selection model. Target audio selection models and/or other suitable models (e.g., audio parameter models, such as those used by tertiary systems) can include any one or more of: probabilistic properties, heuristic properties, deterministic properties, and/or any other suitable properties. Further, Block S120 can and/or other portions of the method 100 can employ machine learning approaches including any one or more of: neural network models, supervised learning, unsupervised learning, semi-supervised learning, reinforcement learning, regression, an instance-based method, a regularization method, a decision tree learning method, a Bayesian method, a kernel method, a clustering method, an associated rule learning algorithm, deep learning algorithms, a dimensionality reduction method, an ensemble method, and/or any suitable form of machine learning algorithm. In an example, Block S120 can include applying a neural network model (e.g., a recurrent neural network, a convolutional neural network, etc.) to select a target audio segment of a plurality of audio segments from an audio dataset, where raw audio data (e.g., raw audio waveforms), processed audio data (e.g., extracted audio features), contextual data (e.g., supplementary sensor data, etc.), and/or other suitable data can be used in the neural input layer of the neural network model. Applying target audio selection models, otherwise selecting target audio data, applying other models, and/or performing any other suitable processes associated with the method 100 can be performed by one or more: earpieces, tertiary units, and/or other suitable components (e.g., system components).

Each model can be run or updated: once; at a predetermined frequency; every time an instance of an embodiment of the method and/or subprocess is performed; every time a trigger condition is satisfied (e.g., detection of audio activity in an audio dataset; detection of voice activity; detection of an unanticipated measurement in the audio data and/or contextual data; etc.), and/or at any other suitable time and frequency. The model(s) can be run and/or updated concurrently with one or more other models (e.g., selecting a target audio dataset with a target audio selection model while determining audio-related parameters based on a different target audio dataset and an audio parameter model; etc.), serially, at varying frequencies, and/or at any other suitable time. Each model can be validated, verified, reinforced, calibrated, and/or otherwise updated (e.g., at a remote computing system; at an earpiece; at a tertiary system; etc.) based on newly received, up-to-date data, historical data and/or be updated based on any other suitable data. The models can be universally applicable (e.g., the same models used across users, audio systems, etc.), specific to users (e.g., tailored to a user's specific hearing condition; tailored to contextual situations associated with the user; etc.), specific to geographic regions (e.g., corresponding to common noises experienced in the geographic region; etc.), specific to temporal indicators (e.g., corresponding to common noises experienced at specific times; etc.), specific to earpiece and/or tertiary systems (e.g., using different models requiring different computational processing power based on the type of earpiece and/or tertiary system; using different models based on the types of sensor data collectable at the earpiece and/or tertiary system; using different models based on different communication conditions, such as signal strength, etc.), and/or can be otherwise applicable across any suitable number and type of entities. In an example, different models (e.g., generated with different algorithms, with different sets of features, with different input and/or output types, etc.) can be applied based on different contextual situations (e.g., using a target audio selection machine learning model for audio datasets associated with ambiguous contextual situations; omitting usage of the model in response to detecting that the earpiece is not being worn and/or detecting a lack of noise; etc.). However, models described herein can be configured in any suitable manner.

Selecting target audio data is preferably performed by one or more earpieces (e.g., using low power digital signal processing; etc.), but can additionally or alternatively be performed at any suitable components (e.g., tertiary systems; remote computing systems; etc.). In an example, Block S120 can include selecting, at an earpiece, target audio data from an audio dataset sampled at the same earpiece. In another example, Block S120 can include collecting a first and second audio dataset at a first and second earpiece, respectively; transmitting the first audio dataset from the first to the second earpiece; and selecting audio data from at least one of the first and the second audio datasets based on an analysis by the audio datasets at the second earpiece. In another example, the method 106 can include selecting first and second target audio data at a first and second earpiece, respectively, and transmitting the first and the second target audio data to the tertiary system using the first and the second earpiece, respectively. However, selecting target audio data can be performed in any suitable manner. In some embodiments, the target audio data simply includes raw audio data received at an earpiece.

Block S120 can additionally include selectively escalating audio data, which functions to determine whether or not to escalate (e.g., transmit) data (e.g., audio data, raw audio data, processed audio data, etc.) from the earpiece to the tertiary system. This can include any or all of: receiving a user input (e.g., indicating a failure of a current earpiece filter); applying a voice activity detection algorithm; determining a signal-to-noise ratio (SNR); determining a ratio of a desired sound source (e.g., voice sound source) to an undesired sound source (e.g., background noise); comparing audio data received at an earpiece with historical audio data; determining an audio parameter (e.g., volume) of a sound (e.g., human voice); determining that a predetermined period of time has passed (e.g., 10 milliseconds (ms), 15 ms, 20 ms, greater than 5 ms, etc.); or any other suitable trigger. In some embodiments, for instance, Block S120 includes determining whether to escalate audio data to a tertiary system based on a voice activity detection algorithm. In a specific embodiment, the voice activity detection algorithm includes determining a volume of a frequency distribution corresponding to human voice and comparing that volume with a volume threshold (e.g., minimum volume threshold, maximum volume threshold, range of volume threshold values, etc.). In another embodiment, Block S120 includes calculating the SNR for the sampled audio at the earpiece (e.g., periodically, continuously), determining that the SNR has fallen below a predetermined SNR threshold (e.g., at a first timestamp), and transmitting the sampled audio (e.g., sampled during a time period preceding and/or following the first timestamp) to the tertiary system upon said determination.

In one embodiment of selective escalation, the tertiary system uses low-power audio spectrum activity heuristics to measure audio activity. During presence of any audio activity, for instance, the earpiece sends audio to the tertiary system for analysis of audio type (e.g., voice, non-voice, etc.). The tertiary system determines what type of filtering must be used and will transmit to the earpiece a time-bounded filter (e.g., a linear combination of microphone frequency coefficients pre-iFFT) that can be used locally. The earpiece uses the filter to locally enhance audio at low power until either the time-bound on the filter has elapsed, or a component of the system (e.g., earpiece) has detected a significant change in audio frequency distribution of magnitude, at which point the audio is re-escalated immediately to the tertiary system for calculation of a new local filter. The average rate of change of filters (e.g., both raw per frequency and Wiener filter calculated as derivative of former) are measured for rate of change. In one example, updates to local filters at the earpiece can be timed such that updates are sent at such a rate as to save battery but maintain high fidelity of filter accuracy.

In some embodiments, audio data is escalated to the tertiary system with a predetermined frequency (e.g., every 10 ms, 15 ms, 20 ms, etc.). In some implementations, for instance, this frequency is adjusted based on the complexity of the audio environment (e.g., number of distinct audio frequencies, variation in amplitude between different frequencies, how quickly the composition of the audio data changes, etc.). In a specific example, for instance, the frequency at which audio data is escalated has a first value in a complex environment (e.g., 5 ms, 10 ms, 15 ms, 20 ms, etc.) and a second value lower than the first value in a less complex environment (e.g., greater than 15 ms, greater than 20 ms, greater than 500 ms, greater than a minute etc.).

In some embodiments, the tertiary system can send (e.g., in addition to a filter, in addition to a time-bounded filter, on its own, etc.) an instruction set of desired data update rates and audio resolution for contextual readiness. These update rates and bitrates are preferably independent of a filter time-bound, as the tertiary system may require historical context to adapt to a new audio phenomena in need of filtering; alternatively, the update rates and bitrates and be related to a filter time-bound.

In some embodiments, any or all of: filters, filter time-bounds, update rates, bit rates, and any other suitable audio or transmission parameters can be based on one or more of a recent audio history, a location (e.g., GPS location) of an earpiece, a time (e.g., current time of day), local signatures (e.g., local Wi-Fi signature, local Bluetooth signature, etc.), a personal history of the user, or any other suitable parameter. In a specific example, the tertiary system can use estimation of presence of voice, presence of noise, and a temporal variance and frequency overlap of each to request variable data rate updates and to set the time-bounds of any given filter. The data rate can then be modified by sample rate, bit depth of sample, presence of one or multiple microphones of data stream, and compression techniques used upon audio sent.

3.4 Transmitting the Target Audio Data from Earpiece to Tertiary System S130

In one embodiment, Block S130 transmits the target audio data from the earpiece to a tertiary system in communication with and proximal the earpiece, which can function to transmit audio data for subsequent use in determining audio-related parameters. Any suitable amount and types of target audio data can be transmitted from one or more earpieces to one or more tertiary systems. Transmitting target audio data is preferably performed in response to selecting the target audio data, but can additionally or alternatively be performed in temporal relation (e.g., serially, in response to, concurrently, etc.) to any suitable trigger conditions (e.g., detection of audio activity, such as based on using low-power audio spectrum activity heuristics; transmission based on filter update rates; etc.), at predetermined time intervals, and/or at any other suitable time and frequency. However, transmitting target audio data can be performed in any suitable manner.

Block S130 preferably includes applying a beamforming process (e.g., protocol, algorithm, etc.) prior to transmission of target audio data from one or more earpieces to the tertiary system. In some embodiments, for instance, beamforming is applied to create a single audio time-series based on audio data from a set of multiple microphones (e.g., 2) of an earpiece. In a specific example, the results of this beamforming are then transmitted to the tertiary system (e.g., instead of raw audio data, in combination with raw audio data, etc.). Additionally or alternatively, any other process of the method can include applying beamforming or the method can be implemented without applying beamforming.

In some embodiments, Block S130 includes transmitting other suitable data to the tertiary system (e.g., in addition to or in lieu of the target audio stream), such as, but not limited to: derived data (e.g., feature values extracted from the audio stream; frequency-power distributions; other characterizations of the audio stream; etc.), earpiece component information (e.g., current battery level), supplementary sensor information (e.g., accelerometer information, contextual data), higher order audio features (e.g., relative microphone volumes, summary statistics, etc.), or any other suitable information.

3.5 Determining Audio-Related Parameters Based on the Target Audio Data S140

In the illustrated embodiment, Block S140 determines audio-related parameters based on the target audio data, which can function to determine parameters configured to facilitate enhanced audio playback at the earpiece. Audio-related parameters can include any one or more of: filters (e.g., time-bounded filters; filters associated with the original audio resolution for full filtering at the earpiece; etc.), update rates (e.g., filter update rates, requested audio update rates, etc.), modified audio (e.g., in relation to sampling rate, such as through up sampling received target audio data prior to transmission back to the earpiece; bit rate; bit depth of sample; presence of one or more microphones associated with the target audio data; compression techniques; resolution, etc.), spatial estimation parameters (e.g., for 3D spatial estimation in synthesizing outputs for earpieces; etc.), target audio selection parameters (e.g., described herein), latency parameters (e.g., acceptable latency values), amplification parameters, contextual situation determination parameters, other parameters and/or data described in relation to Block S120, S170, and/or other suitable portions of the method 100, and/or any other suitable audio-related parameters. Additionally or alternatively, such determinations can be performed at one or more: earpieces, additional tertiary systems, and/or other suitable components. Filters are preferably time-bounded to indicate a time of initiation at the earpiece and a time period of validity, but can alternatively be time-independent. Filters can include a combination of microphone frequency coefficients (e.g., a linear combination pre-inverse fast Fourier transform), raw per frequency coefficients, Wiener filters (e.g., for temporal specific signal-noise filtering, etc.), and/or any other data suitable for facilitating application of the filters at an earpiece and/or other components. Filter update rates preferably indicate the rate at which local filters at the earpiece are updated (e.g., through transmission of the updated filters from the tertiary system to the earpiece; where the filter update rates are independent of the time-bounds of filters; etc.), but any suitable update rates for any suitable types of data (e.g., models, duration of target audio data, etc.) can be determined.

Determining audio-related parameters is preferably based on the target audio data (e.g., audio features extracted from the target audio data; target audio data selected from earpiece audio, from remote audio sensor audio, etc.) and/or contextual audio (e.g., historical audio data, historical determined audio-related parameters, etc.). In an example, determining audio-related parameters can be based on target audio data and historical audio data (e.g., for fast Fourier transform at suitable frequency granularity target parameters; 25-32 ms; at least 32 ms; and/or other suitable durations; etc.). In another example, Block S140 can include applying an audio window (e.g., the last 32 ms of audio with a moving window of 32 ms advanced by the target audio); applying a fast Fourier transform and/or other suitable transformation; and applying an inverse fast Fourier transform and/or other suitable transformation (e.g., on filtered spectrograms) for determination of audio data (e.g., the resulting outputs at a length of the last target audio data, etc.) for playback. Additionally or alternatively, audio-related parameters (e.g., filters, streamable raw audio, etc.) can be determined in any manner based on target audio data, contextual audio data (e.g., historical audio data), and/or other suitable audio-related data. In another example, Block S140 can include analyzing voice activity and/or background noise for the target audio data. In specific examples, Block S140 can include determining audio-related parameters for one or more situations including: lack of voice activity with quiet background noise (e.g., amplifying all sounds; exponentially backing off filter updates, such as to an update rate of every 500 ms or longer, in relation to location and time data describing a high probability of a quiet environment; etc.); voice activity and quiet background noise (e.g., determining filters suitable for the primary voice frequencies present in the phoneme; reducing filter update rate to keep filters relatively constant over time; updating filters at a rate suitable to account for fluctuating voices, specific phonemes, and vocal stages, such as through using filters with a lifetime of 10-30 ms; etc.); lack of voice activity with constant, loud background noise (e.g., determining a filter for removing the background noise; exponentially backing off filter rates, such as up to 500 ms; etc.); voice activity and constant background noise (e.g., determining a high frequency filter update for accounting for voice activity; determining average rate of change to transmitted local filters, and timing updates to achieve target parameters of maintaining accuracy while leveraging temporal consistencies; updates every 10-15 ms; etc.); lack of voice activity with variable background noise (e.g., determining Bayesian Prior for voice activity based on vocal frequencies, contextual data such as location, time, historical contextual and/or audio data, and/or other suitable data; escalating audio data for additional filtering, such as in response to Bayesian Prior and/or other suitable probabilities satisfying threshold conditions; etc.); voice activity and variable background noise (e.g., determining a high update rate, high audio sample data rate such as for bit rate, sample rate, number of microphones; determining filters for mitigating connection conditions; determining modified audio for acoustic actuation; etc.); and/or for any other suitable situations.

In an embodiment, determining audio-related parameters can be based on contextual data (e.g., received from the earpiece, user mobile device, and/or other components; collected at sensors of the tertiary system; etc.). For example, determining filters, time bounds for filters, update rates, bit rates, and/or other suitable audio-related parameters can be based on user location (e.g., indicated by GPS location data collected at the earpiece and/or other components; etc.), time of day, communication parameters (e.g., signal strength; communication signatures, such as for Wi-Fi and Bluetooth connections; etc.), user datasets (e.g., location history, time of day history, etc.), and/or other suitable contextual data (e.g., indicative of contextual situations surrounding audio profiles experienced by the user, etc.). In another embodiment, determining audio-related parameters can be based on target parameters. In a specific example, determining filter update rates can be based on average rate of change of filters (e.g., for raw per frequency filters, Wiener filters, etc.) while achieving target parameters of saving battery life and maintaining a high fidelity of filter accuracy for the contextual situation.

In some embodiments, Block S140 includes determining a location (e.g., GPS coordinates, location relative to a user, relative direction, pose, orientation etc.) of a sound source, which can include any or all of: beamforming, spectrally-enhanced beamforming of an acoustic location, determining contrastive power between sides of a user's head (e.g., based on multiple earpieces), determining a phase difference between multiple microphones of a single and/or multiple earpieces, using inertial sensors to determine a center of gaze, determining peak triangulation among earpieces and/or a tertiary system and/or co-linked partner systems (e.g., neighboring tertiary systems of a single or multiple users), or through any other suitable process.

In another embodiment, Block S140 can include determining audio-related parameters based on contextual audio data (e.g., associated with a longer time period than that associated with the target audio data, associated with a shorter time period; associated with any suitable time period and/or other temporal indicator, etc.) and/or other suitable data (e.g., the target audio data, etc.). For example, Block S140 can include: determining a granular filter based on an audio window generated from appending the target audio data (e.g., a 4 ms audio segment) to historical target audio data (e.g., appending the 4 ms audio segment to 28 ms of previously received audio data to produce a 32 ms audio segment for a fast Fourier transform calculation, etc.). Additionally or alternatively, contextual audio data can be used in any suitable aspects of Block S140 and/or other suitable processes of the method 100. For example, Block S140 can include applying a historical audio window (e.g., 32 ms) for computing a transformation calculation (e.g., fast Fourier transform calculation) for inference and/or other suitable determination of audio-related parameters (e.g., filters, enhanced audio data, etc.). In another example, Block S140 can include determining audio related parameters (e.g., for current target audio) based on a historical audio window (e.g., 300 s of audio associated with low granular direct access, etc.) and/or audio-related parameters associated with the historical audio window (e.g., determined audio-related parameters for audio included in the historical audio window, etc.), where historical audio-related parameters can be used in any suitable manner for determining current audio-related parameters. Examples can include comparing generated audio windows to historical audio windows (e.g., a previously generated 32 ms audio window) for determining new frequency additions from the target audio data (e.g., the 4 ms audio segment) compared to the historical target audio data (e.g., the prior 28 ms audio segment shared with the historical audio window); and using the new frequency additions (and/or other extracted audio features) to determine frequency components of voice in a noisy signal for use in synthesizing a waveform estimate of the desired audio segment including a last segment for use in synthesizing a real-time waveform (e.g., with a latency less than that of the audio window required for sufficient frequency resolution for estimation, etc.). Additionally or alternatively, any suitable durations can be associated with the target audio data, the historical target audio data, the audio windows, and/or other suitable audio data in generating real-time waveforms. In a specific example, Block S140 can include applying a neural network (e.g., recurrent neural network) with a feature set derived from the differences in audio windows (e.g., between a first audio window and a second audio window shifted by 4 ms, etc.).

In another embodiment, Block S140 can include determining spatial estimation parameters (e.g. for facilitating full 3D spatial estimation of designed signals for each earpiece of a pair; etc.) and/or other suitable audio-related parameters based on target audio data from a plurality of audio sources (e.g., earpiece microphones, tertiary systems, remote microphones, telecoils, networked earpieces associated with other users, user mobile devices, etc.) and/or other suitable data. In an example, Block S140 can include determining virtual microphone arrays (e.g., for superior spatial resolution in beamforming) based on the target audio data and location parameters. The location parameters can include locations of distinct acoustic sources, such as speakers, background noise sources, and/or other sources, which can be determined based on combining acoustic cross correlation with poses for audio streams relative each other in three-dimensional space (e.g., estimated from contextual data, such as data collected from left and right earpieces, data suitable for RF triangulation, etc.). Estimated digital audio streams can be based on combinations of other digital streams (e.g., approximate linear combinations), and trigger conditions (e.g., connection conditions such as an RF linking error, etc.) can trigger the use of a linear combination of other digital audio streams to replace a given digital audio stream. In another embodiment, Block S140 includes applying audio parameter models analogous to any models and/or approaches described herein (e.g., applying different audio parameter models for different contextual situations, for different audio parameters, for different users; applying models and/or approaches analogous to those described in relation to Block S120; etc.). However, determining audio-related parameters can be based on any suitable data, and Block S140 can be performed in any suitable manner.

3.6 Transmitting Audio-Related Parameters to the Earpiece S150

Figure 4:
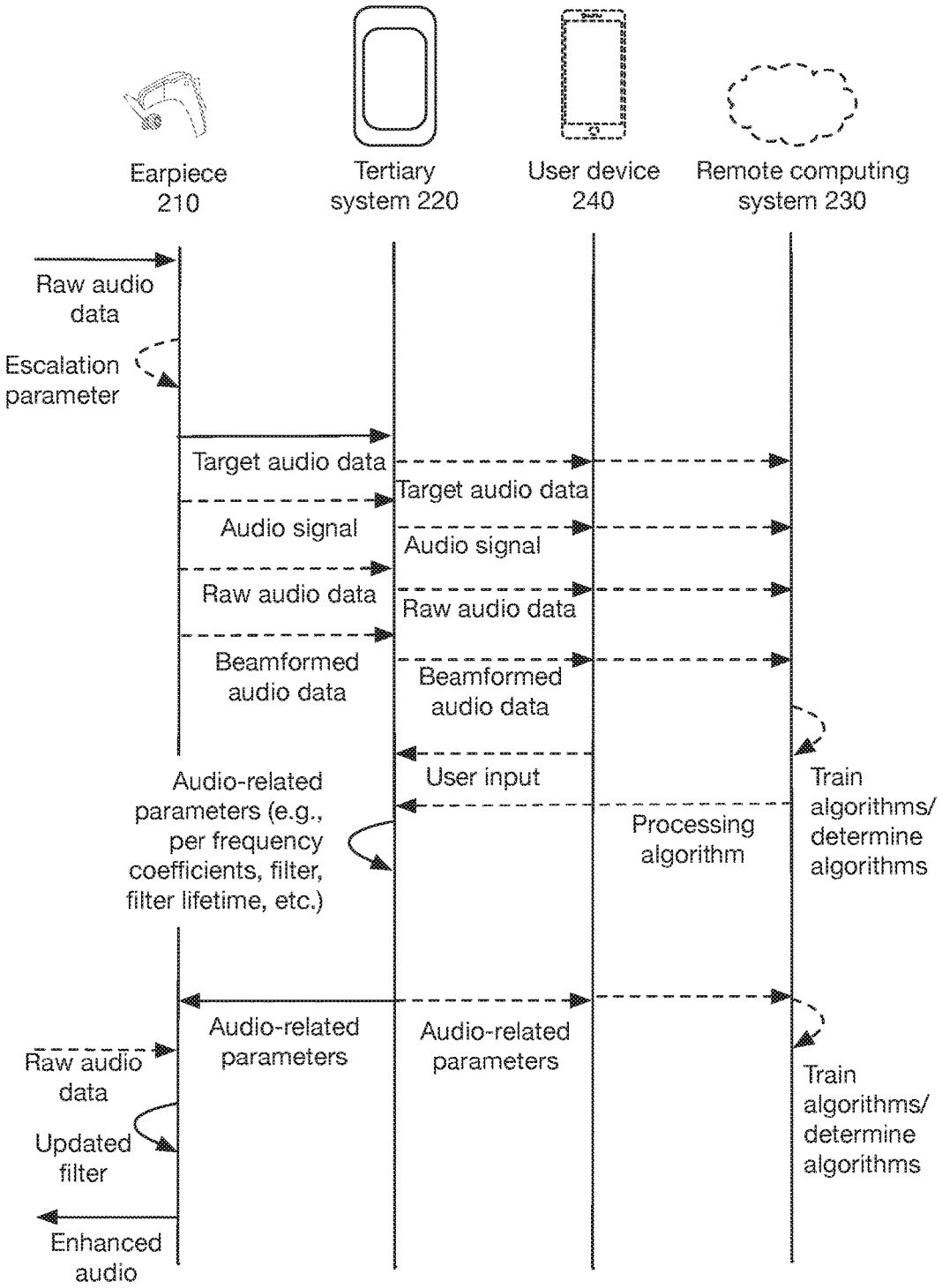
FIG. 4 is a sequence diagram illustrating information flow between system components in accordance with an embodiment of the invention.

Block S150 recites: transmitting audio-related parameters to the earpiece, which can function to provide parameters to the earpiece for enhancing audio playback. The audio-related parameters are preferably transmitted by a tertiary system to the earpiece but can additionally or alternatively be transmitted by any suitable component (e.g., remote computing system; user mobile device; etc.). As shown in FIG. 4, any suitable number and types of audio-related parameters (e.g., filters, Wiener filters, a set of per frequency coefficients, coefficients for filter variables, frequency masks of various frequencies and bit depths, expected expirations of the frequency masks, conditions for re-evaluation and/or updating of a filter, ranked lists and/or conditions of local algorithmic execution order, requests for different data rates and/or types from the earpiece, an indication that one or more processing steps at the tertiary system have failed, temporal coordination data between earpieces, volume information, Bluetooth settings, enhanced audio, raw audio for direct playback, update rates, lifetime of a filter, instructions for audio resolution, etc.) can be transmitted to the earpiece. In a first embodiment, Block S150 transmits audio data (e.g., raw audio data, audio data processed at the tertiary system, etc.) to the earpiece for direct playback. In a second embodiment, Block S150 includes transmitting audio-related parameters to the earpiece for the earpiece to locally apply. For example, time-bounded filters transmitted to the earpiece can be locally applied to enhance audio at low power. In a specific example, time-bounded filters can be applied until one or more of: elapse of the time-bound, detection of a trigger condition such as a change in audio frequency distribution of magnitude beyond a threshold condition, and/or any other suitable criteria. The cessation of a time-bounded filter (and/or other suitable trigger conditions) can act as a trigger condition for selecting target audio data to escalate (e.g., as in Block S120) for determining updated audio-related parameters, and/or can trigger any other suitable portions of the method 100. However, transmitting audio-related parameters can be performed in any suitable manner.

In one embodiment, S150 includes transmitting a set of frequency coefficients from the tertiary system to one or more earpieces. In a specific implementation, for instance, the method includes transmitting a set of per frequency coefficients from the tertiary system to the earpiece, wherein incoming audio data at the earpiece is converted from a time series to a frequency representation, the frequencies from the frequency representation are multiplied by the per frequency coefficients, the resulting frequencies are transformed back into a time series of sound, and the time series is played out at a receiver (e.g., speaker) of the earpiece.

In alternative embodiments, the frequency filter is in the time domain (e.g., a finite impulse response filter, an infinite impulse response filter, or other time domain) such that there is no need to transform the time-series audio to the frequency domain and then back to the time domain.

In another embodiment, S150 includes transmitting a filter (e.g., Wiener filter) from the tertiary system to one or more earpieces. In a specific implementation, for instance, the method includes transmitting a Wiener filter from the tertiary system to an earpiece, wherein incoming audio data at the earpiece is converted from a time series to a frequency representation, the frequencies are adjusted based on the filter, and the adjusted frequencies are converted back into a time series for playback through a speaker of the earpiece.

Block S150 can additionally or alternatively include selecting a subset of antennas 214 of the tertiary system for transmission (e.g., by applying RF beamforming). In some embodiments, for instance, a subset of antennas 214 (e.g., a single antenna, two antennas, etc.) is chosen based on having the highest signal strength among the set. In a specific example, a single antenna 214 having the highest signal strength is selected for transmission in a first scenario (e.g., when only a single radio of a tertiary system is needed to communicate with a set of earpieces and a low bandwidth rate will suffice) and a subset of multiple antennas 214 (e.g., 2) having the highest signal is selected for transmission in a second scenario (e.g., when communicating with multiple earpieces simultaneously and a high bandwidth rate is needed). Additionally or alternatively, any number of antennas 214 (e.g., all) can be used in any suitable set of scenarios.

In some embodiments, the tertiary system transmits audio data (e.g., raw audio data) for playback at the earpiece. In a specific example, an earpiece may be requested to send data to the tertiary system at a data rate that is lower than will eventually be played back; in this case, the tertiary system can up sample the data before transmitting to the earpiece (e.g., for raw playback). The tertiary system can additionally or alternatively send a filter back at the original audio resolution for full filtering.

3.7 Handling Connection Conditions S160

The method can additionally or alternatively include Block S160, which recites: handling connection conditions between an earpiece and a tertiary system. Block S160 can function to account for connection faults (e.g., leading to dropped packets, etc.) and/or other suitable connection conditions to improve reliability of the hearing system. Connection conditions can include one or more of: interference conditions (e.g., RF interference, etc.), cross-body transmission, signal strength conditions, battery life conditions, and/or other suitable conditions. Handling connection conditions preferably includes: at the earpiece, locally storing (e.g., caching) and applying audio-related parameters including one or more of received time-bounded filters (e.g., the most recently received time-bounded filter from the tertiary system, etc.), processed time-bounded filters (e.g., caching the average of filters for the last contiguous acoustic situation in an exponential decay, where detection of connection conditions can trigger application of a best estimate signal-noise filter to be applied to collected audio data, etc.), other audio-related parameters determined by the tertiary system, and/or any other suitable audio-related parameters. In one embodiment, Block S160 includes: in response to trigger conditions (e.g., lack of response from the tertiary system, expired time-bounded filter, a change in acoustic conditions beyond a threshold, etc.), applying a recently used filter (e.g., the most recently used filter, such as for situations with similarity to the preceding time period in relation to acoustic frequency and amplitude; recently used filters for situations with similar frequency and amplitude to those corresponding to the current time period; etc.). In another embodiment, Block S160 includes transitioning between locally stored filters (e.g., smoothly transitioning between the most recently used filter and a situational average filter over a time period, such as in response to a lack of response from the tertiary system for a duration beyond a time period threshold, etc.). In another embodiment, Block S160 can include applying (e.g., using locally stored algorithms) Wiener filtering, spatial filtering, and/or any other suitable types of filtering. In another embodiment, Block S160 includes modifying audio selection parameters (e.g., at the tertiary system, at the earpiece; audio selection parameters such as audio selection criteria in relation to sample rate, time, number of microphones, contextual situation conditions, audio quality, audio sources, etc.), which can be performed based on optimizing target parameters (e.g., increasing re-transmission attempts; increasing error correction affordances for the transmission; etc.). In another embodiment, Block S160 can include applying audio compression schemes (e.g., robust audio compression schemes, etc.), error correction codes, and/or other suitable approaches and/or parameters tailored to handling connection conditions. In another embodiment, Block S160 includes modifying (e.g., dynamically modifying) transmission power, which can be based on target parameters, contextual situations (e.g., classifying audio data as important in the context of enhancement based on inferred contextual situations; etc.), device status (e.g., battery life, proximity, signal strength, etc.), user data (e.g., preferences; user interactions with system components such as recent volume adjustments; historical user data; etc.), and/or any other suitable criteria. However, handling connection conditions can be performed in any suitable manner.

In some embodiments, S160 includes adjusting a set of parameters of the target audio data and/or parameters of the transmission (e.g., frequency of transmission, number of times the target audio data is sent, etc.) prior to, during, or after transmission to the tertiary system. In a specific example, for instance, multiple instances of the target audio data are transmitted (e.g., and a bit depth of the target audio data is decreased) to the tertiary system (e.g., to account for data packet loss).

In some embodiments, S160 includes implementing any number of techniques to mitigate connection faults in order to enable to method to proceed in the event of dropped packets (e.g., due to RF interference and/or cross-body transmission).

In some embodiments of S160, an earpiece will cache an average of filters for a previous (e.g., last contiguous, historical, etc.) acoustic situation in an exponential decay such that if at any time connection (e.g., between the earpiece and tertiary system) is lost, a best estimate filter can be applied to the audio. In a specific example, if the earpiece seeks a new filter from the pocket unit due to an expired filter or a sudden change in acoustic conditions, the earpiece can use the exact filter as previously used if acoustic frequency and amplitude are similar for a short duration. The earpiece can also have access to a cached set of recent filters based on similar frequency and amplitude maps in the recent context. In the event that the earpiece seeks a new filter from the tertiary system due to an expired filter or a sudden change in acoustic conditions and for an extended period does not receive an update, the earpiece can perform a smooth transition between the previous filter and the situational average filter over the course of a number of audio segments such that there is no discontinuity in sound. Additionally or alternatively, the earpiece may fall back to traditional Weiner & spatial filtering using the local onboard algorithms if the pocket unit's processing is lost.

3.8 Modifying Latency Parameters, Amplification Parameters, and/or any Other Suitable Parameters The method can additionally or alternatively include Block S170, which recites: modifying latency parameters, amplification parameters, and/or other suitable parameters (e.g., at an earpiece and/or other suitable components) based on a contextual dataset describing a user contextual situation. Block S170 can function to modify latency and/or frequency of amplification for improving cross-frequency latency experience while enhancing audio quality (e.g., treating inability to hear quiet sounds in frequencies; treating inability to separate signal from noise; etc.). For example, Block S170 can include modifying variable latency and frequency amplification depending on whether target parameters are directed towards primarily amplifying audio, or increasing signal-to-noise ratio above an already audible acoustic input. In specific examples, Block S170 can be applied for situations including one or more of: quiet situations with significant low frequency power from ambient air conduction (e.g., determining less than or equal to 10 ms latency such that high frequency amplification is synchronized to the low frequency components of the same signal; etc.); self vocalization with significant bone conduction of low frequencies (e.g., determining less than or equal to 10 ms latency for synchronization of high frequency amplification to the low frequency components of the same signal; etc.); high noise environments with non-self vocalization (e.g., determining amplification for all frequencies above the amplitude of the background audio, such as at 2-8 dB depending on the degree of signal-to-noise ratio loss experienced by the user; determining latency as greater than toms due to a lack of a synchronization issue and; determining latency based on scaling proportion to the sound pressure level ratio of produced audio above background noise; etc.); and/or any other suitable situations. Block S170 can be performed by one or more of: tertiary systems, earpieces, and/or other suitable components. However, modifying latency parameters, amplification parameters, and/or other suitable parameters can be performed in any suitable manner.

In one embodiment of the method 100, the method includes collecting raw audio data at multiple microphones of an earpiece; selecting, at the earpiece, target audio data for enhancement from the audio dataset; determining to transmit target audio data to the tertiary system based on a selective escalation process; transmitting the target audio data from the earpiece to a tertiary system in communication with and proximal the earpiece; determining a set of filter parameters based on the target audio data; and transmitting the filter parameters to the earpiece for facilitating enhanced audio playback at the earpiece. Additionally or alternatively, the method 100 can include any other suitable steps, omit any of the above steps (e.g., automatically transmit audio data without a selective escalation mode), or be performed in any other suitable way.

4. System

Embodiments of the method 100 are preferably performed with a system 200 as described but can additionally or alternatively be performed with any suitable system. Similarly, the system 200 described below is preferably configured to performed embodiments of the method 200 described above but additionally or alternatively can be used to perform any other suitable process(es).

As shown in FIG. 2, embodiments of a system 200 can include one or more earpieces and tertiary systems. Additionally or alternatively, embodiments of the system 200 can include one or more: remote computing systems; remote sensors (e.g., remote audio sensors, etc.); user devices (e.g., smartphone, laptop, tablet, desktop computer, etc.); and/or any other suitable components. The components of the system 100 can be physically and/or logically integrated in any manner (e.g., with any suitable distributions of functionality across the components in relation to portions of the method 100; etc.). For example, different amounts and/or types of signal processing for collected audio data and/or contextual data can be performed by one or more earpieces and a corresponding tertiary system (e.g., applying low power signal processing at an earpiece to audio datasets satisfying a first set of conditions; applying high power signal processing at the tertiary system for audio datasets satisfying a second set of conditions; etc.). In another example, signal processing aspects of the method 100 can be completely performed by the earpiece, such as in situations where the tertiary system is unavailable (e.g., an empty state-of-charge, faulty connection, out of range, etc.). In another example, distributions of functionality can be determined based on latency targets and/or other suitable target parameters (e.g., different types and/or allocations of signal processing based on a low-latency target versus a high-latency target; different data transmission parameters; etc.). Distributions of functionality can be dynamic (e.g., varied based on contextual situation such as in relation to the contextual environment, current device characteristics, user, and/or other suitable criteria; etc.), static (e.g., similar allocations of signal processing across multiple contextual situations; etc.), and/or configured in any suitable manner. Communication by and/or between any components of the system can include wireless communication (e.g., Wi-Fi, Bluetooth, radiofrequency, etc.), wired communication, and/or any suitable types of communication.

In some embodiments, communication between components (e.g., earpiece and tertiary system) is established through an RF system (e.g., having a frequency range of 0 to 16,000 Hertz). Additionally or alternatively, a different communication system can be used, multiple communication systems can be used (e.g., RF between a first set of system elements and Wi-Fi between a second set of system elements), or elements of the system can communicate in any other suitable way.

Tertiary device 220 (or other another suitable auxiliary processing device/pocket unit) is preferably provided with a processor capable of executing more than 12,000 million operations per second, and more preferably more than 120,000 million operations per second (also referred in the art as 120 Giga Operations Per Second or GOPS). In some embodiments System 200 may be configured to combine this relatively powerful tertiary system 220 with an earpiece 210 having a size, weight, and battery life comparable to that of the Oticon Opn™ or other similar ear-worn systems known in the related art. Earpiece 210 is preferably configured to have a battery life exceeding 70 hours using battery consumption measurement standard IEC 60118-0+A1:1994.

4.1 Earpiece

Figure 3:
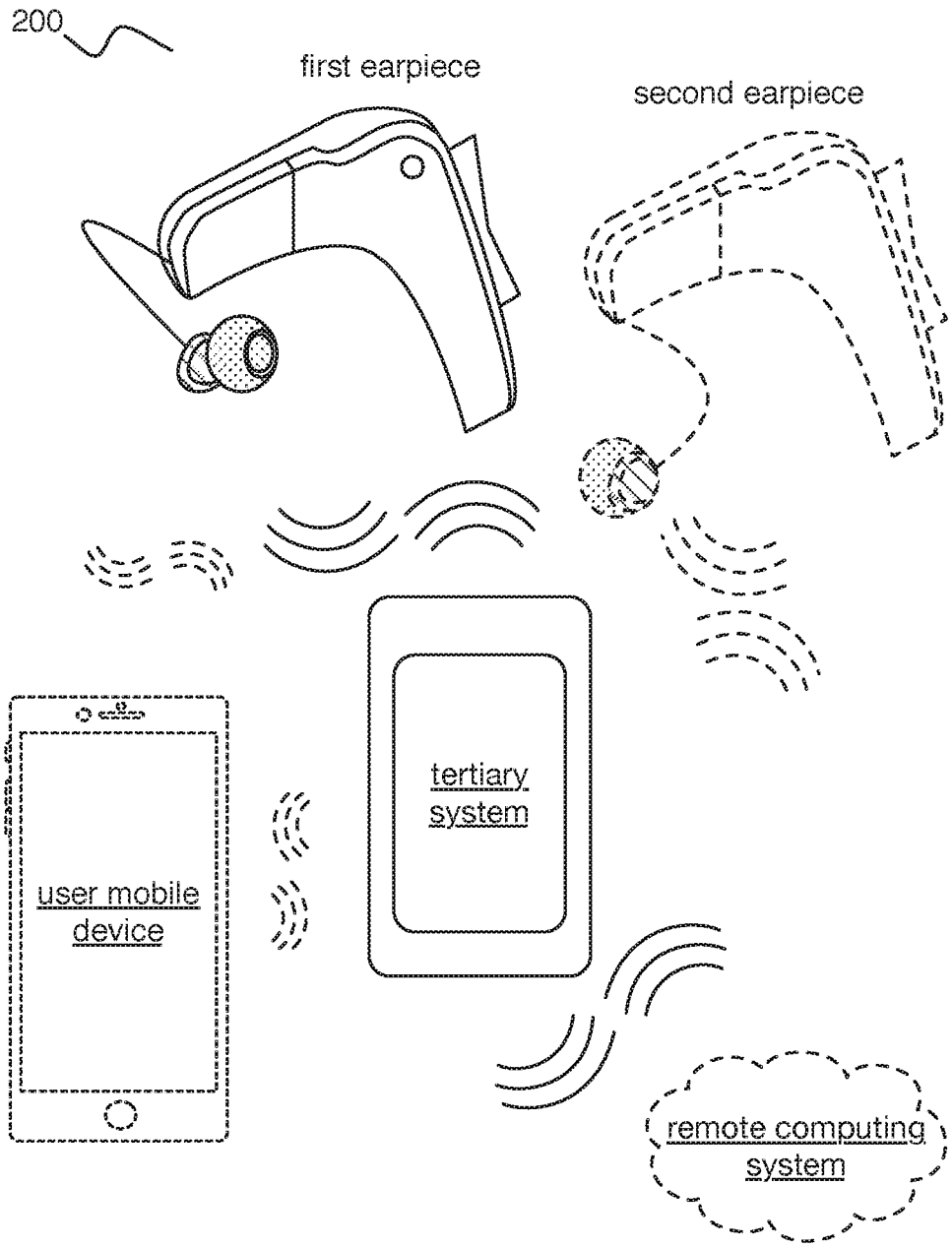
FIG. 3 illustrates components of the system of FIG. 2.

The system 200 can include a set of one or more earpieces 210 (e.g., as shown in FIG. 3), which functions to sample audio data and/or contextual data, select audio for enhancement, facilitate variable latency and frequency amplification, apply filters (e.g., for enhanced audio playback at a speaker of the earpiece), play audio, and/or perform other suitable operations in facilitating audio enhancement. Earpieces (e.g., hearing aids) 210 can include one or more: audio sensors 212 (e.g., a set of two or more microphones; a single microphone; telecoils; etc.), supplementary sensors, communication subsystems (e.g., wireless communication subsystems including any number of transmitters having any number of antennas 214 configured to communicate with the tertiary system, with a remote computing system; etc.), processing subsystems (e.g., computing systems; digital signal processor (DSP); signal processing components such as amplifiers and converters; storage; etc.), power modules, interfaces (e.g., a digital interface for providing control instructions, for presenting audio-related information; a tactile interface for modifying settings associated with system components; etc.); speakers; and/or other suitable components. Supplementary sensors of the earpiece and/or other suitable components (e.g., a tertiary system; etc.) can include one or more: motion sensors (e.g., accelerators, gyroscope, magnetometer, etc.), optical sensors (e.g., image sensors, light sensors, etc.), pressure sensors, temperature sensors, volatile compound sensors, weight sensors, humidity sensors, depth sensors, location sensors, impedance sensors (e.g., to measure bio-impedance), biometric sensors (e.g., heart rate sensors, fingerprint sensors), flow sensors, power sensors (e.g., Hall effect sensors), and/or or any other suitable sensor. The system 200 can include any suitable number of earpieces 210 (e.g., a pair of earpieces worn by a user; etc.). In an example, a set of earpieces can be configured to transmit audio data in an interleaved manner (e.g., to a tertiary system including a plurality of transceivers; etc.). In another example, the set of earpieces can be configured to transmit audio data in parallel (e.g., contemporaneously on different channels), and/or at any suitable time, frequency, and temporal relationship (e.g., in serial, in response to trigger conditions, etc.). In some embodiments, one or more earpieces are selected to transmit audio based on satisfying one or more selection criteria, which can include any or all of: having a signal parameter (e.g., signal quality, signal-to-noise ratio, amplitude, frequency, number of different frequencies, range of frequencies, audio variability, etc.) above a predetermined threshold, having a signal parameter (e.g., amplitude, variability, etc.) below a predetermined threshold, audio content (e.g., background noise of a particular amplitude, earpiece facing away from background noise, amplitude of voice noise, etc.), historical audio data (e.g., earpiece historically found to be less obstructed, etc.), or any other suitable selection criterion or criteria. However, earpieces can be configured in any suitable manner.

In one embodiment, the system 200 includes two earpieces 210, one for each ear of the user. This can function to increase a likelihood of a high quality audio signal being received at an earpiece (e.g., at an earpiece unobstructed from a user's hair, body, acoustic head shadow; at an earpiece receiving a signal having a high signal-to-noise ratio; etc.), increase a likelihood of high quality target audio data signal being received at a tertiary system from an earpiece (e.g., received from an earpiece unobstructed from the tertiary system; received from multiple earpieces in the event that one is obstructed; etc.), enable or assist in enabling the localization of a sound source (e.g., in addition to localization information provided by having a set of multiple microphones in each earpiece), or perform any other suitable function. In a specific example, each of these two earpieces 210 of the system 200 includes two microphones 212 and a single antenna 214.

Each earpiece 210 preferably includes one or more processors 250 (e.g., a DSP processor), which function to perform a set of one or more initial processing steps (e.g., to determine target audio data, to determine if and/or when to escalate/transmit audio data to the tertiary system, to determine if and/or when to escalate/transmit audio data to a remote computing system or user device, etc.). The initial processing steps can include any or all of: applying one or more voice activity detection (VAD) processes (e.g., processing audio data with a VAD algorithm, processing raw audio data with a VAD algorithm to determine a signal strength of one or more frequencies corresponding to human voice, etc.), determining a ratio based on the audio data (e.g., SNR, voice to non-voice ratio, conversation audio to background noise ratio, etc.), determining one or more escalation parameters (e.g., based on a value of a VAD, based on the determination that a predetermined interval of time has passed, determining when to transmit target audio data to the tertiary system, determining how often to transmit target audio data to the tertiary system, determining how long to apply a particular filter at the earpiece, etc.), or any other suitable process. In one embodiment, a processor implements a different set of escalation parameters (e.g., frequency of transmission to tertiary system, predetermined time interval between subsequent transmissions to the tertiary system, etc.) depending on one or audio characteristics (e.g., audio parameters) of the audio data (e.g., raw audio data). In a specific example, for instance, if an audio environment is deemed complex (e.g., many types of noise, loud background noise, rapidly changing, etc.), target audio data can be transmitted once per a first predetermined interval of time (e.g., 20 ms, 15 ms, 10 ms, greater than 10 ms, etc.), and if an audio environment is deemed simple (e.g., overall quiet, no conversations, etc.), target audio data can be transmitted once per a second predetermined interval of time (e.g., longer than the first predetermined interval of time, greater than 20 ms, etc.).

Additionally or alternatively, one or more processors 250 of the earpiece can function to process/alter audio data prior to transmission to the tertiary system 220. This can include any or all of: compressing audio data (e.g., through bandwidth compression, through compression based on/leveraging the Mel-frequency cepstrum, reducing bandwidth from 16 kHz to 8 kHz, etc.), altering a bit rate (e.g., reducing bit rate, increasing bit rate), altering a sampling rate, altering a bit depth (e.g., reducing bit depth, increasing bit depth, reducing bit depth from 16 bit depth to 8 bit depth, etc.), applying a beamforming or filtering technique to the audio data, or altering the audio data in other suitable way. Alternatively, raw audio data can be transmitted from one or more earpieces to the tertiary system.

The earpiece preferably includes storage, which functions to store one or more filters (e.g., frequency filter, Wiener filter, low-pass, high-pass, band-pass, etc.) or sets of filter parameters (e.g., masks, frequency masks, etc.), or any other suitable information. These filters and/or filter parameters can be stored permanently, temporarily (e.g., until a predetermined interval of time has passed), until a new filter or set of filter parameters arrives, or for any other suitable time and based on any suitable set of triggers. In one embodiment, one or more sets of filter parameters (e.g., per frequency coefficients, Wiener filters, etc.) are cached in storage of the earpiece, which can be used, for instance, in a default earpiece filter (e.g. when connectivity conditions between an earpiece and tertiary system are poor, when a new filter is insufficient, when the audio environment is complicated, when an audio environment is changing or expected to change suddenly, based on feedback from a user, etc.). Additionally or alternatively, any or all of the filters, filter parameters, and other suitable information can be stored in storage at a tertiary system, remote computing system (e.g., cloud storage), a user device, or any other suitable location.

4.2 Tertiary System

In the illustrated embodiment, system 200 includes tertiary system 220, which functions to determine audio-related parameters, receive and/or transmit audio-related data (e.g., to earpieces, remote computing systems, etc.), and/or perform any other suitable operations. A tertiary system 220 preferably includes a different processing subsystem than that included in an earpiece (e.g., a processing subsystem with relatively greater processing power; etc.), but can alternatively include a same or similar type of processing subsystem. Tertiary systems can additionally or alternatively include: sensors (e.g., supplementary audio sensors), communication subsystems (e.g., including a plurality of transceivers; etc.), power modules, interfaces (e.g., indicating state-of-charge, connection parameters describing the connection between the tertiary system and an earpiece, etc.), storage (e.g., greater storage than in earpiece, less storage than in earpiece, etc.), and/or any other suitable components. However, the tertiary system can be configured in any suitable manner.

Tertiary system 220 preferably includes a set of multiple antennas, which function to transmit filters and/or filter parameters (e.g., per frequency coefficients, filter durations/lifetimes, filter update frequencies, etc.) to one or more earpieces, receive target audio data and/or audio parameters (e.g., latency parameters, an audio score, an audio quality score, etc.) from another component of the system (e.g., earpiece, second tertiary system, remote computing system, user device, etc.), optimize a likelihood of success of signal transmission (e.g., based on selecting one or more antennas having the highest signal strength among a set of multiple antennas) to one or more components of the system (e.g., earpiece, second tertiary system, remote computing system, user device, etc.), optimize a quality or strength of a signal received at another component of the system (e.g., earpiece). Alternatively, the tertiary system can include a single antenna. In some embodiments, the one or more antennas of the tertiary system can be co-located (e.g., within the same housing, in separate housings but within a predetermined distance of each other, in separate housings but at a fixed distance with respect to each other, less than 1 meter away from each other, less than 2 meters away, etc.), but alternatively do not have to be co-located.

The tertiary system 220 can additionally or alternatively include any number of wired or wireless communication components (e.g., RF chips, Wi-Fi chips, Bluetooth chips, etc.). In one embodiment, for instance, the system 200 includes a set of multiple chips (e.g., RF chips, chips configured for communication in a frequency range between 0 and 16 kHz) associated with a set of multiple antennas. In one embodiment, for instance, the tertiary system 220 includes between 4 and 5 antennas associated with between 2 and 3 wireless communication chips. In a specific example, for instance, each communication chip is associated with (e.g., connected to) between 2 and 3 antennas.

In some embodiments, the tertiary system 220 includes a set of user inputs/user interfaces configured to receive user feedback (e.g., rating of sound provided at earpiece, 'yes' or 'no' indication to success of audio playback, audio score, user indication that a filter needs to be updated, etc.), adjust a parameter of audio playback (e.g., change volume, turn system on and off, etc.), or perform any other suitable function. These can include any or all of: buttons, touch surfaces (e.g., touch screen), switches, dials, or any other suitable input/interface. Additionally or alternatively, the set of user inputs/user interfaces can be present within or on a user device separate from the tertiary system (e.g., smartphone, application executing on a user device). Any user device 240 of the system is preferably separate and distinct from the tertiary system 220. However, in alternative embodiments, a user device such as user device 240 may function as the auxiliary processing unit carrying out the functions that, in other embodiments described herein, are performed by tertiary system 220. Also, in other embodiments, a system such as system 200 can be configured to operate without a separate user devise such as user device 240.

In a specific example, the tertiary system 220 includes a set of one or more buttons configured to receive feedback from a user (e.g., quality of audio playback), which can initiate a trigger condition (e.g., replacement of current filter with a cached default filter).

The tertiary system 220 preferably includes a housing and is configured to be worn on or proximal to a user, such as within a garment of the user (e.g., within a pants pocket, within a jacket pocket, held in a hand of the user, etc.). The tertiary system 220 is further preferably configured to be located within a predetermined range of distances and/or directions from each of the earpieces (e.g., less than one meter away from each earpiece, less than 2 meters away from each earpieces, determined based on an size of user, determined based on an average size of a user, substantially aligned along a z-direction with respect to each earpiece, with minimal offset along x- and y-axes with respect to one or more earpieces, within any suitable communication range, etc.), thereby enabling sufficient communication between the tertiary system and earpieces. Additionally or alternatively, the tertiary system 220 can be arranged elsewhere, arranged at various locations (e.g., as part of a user device), or otherwise located.

In one embodiment, the tertiary system and earpiece have multiple modes of interaction (e.g., 2 modes). For example, in a first mode, the earpiece transmits raw audio to the tertiary device pocket unit, and receives raw audio back for direct playback and, in a second mode, the pocket unit transmits back filters for local enhancement. In an alternative embodiment, the tertiary system and earpiece can interact in a single mode.

4.3 Remote Computing System

The system 200 can additionally or alternatively include a remote computing system 230 (e.g., including one or more servers), which can function to receive, store, process, and/or transmit audio-related data (e.g., sampled data; processed data; compressed audio data; tags such as temporal indicators, user identifiers, GPS and/or other location data, communication parameters associated with Wi-Fi, Bluetooth, radiofrequency, and/or other communication technology; determined audio-related parameters for building a user profile; user datasets including logs of user interactions with the system 200; etc.). The remote computing system is preferably configured to generate, store, update, transmit, train, and/or otherwise process models (e.g., target audio selection models, audio parameter models, etc.). In an example, the remote computing system can be configured to generate and/or update personalized models (e.g., updated based on voices, background noises, and/or other suitable noise types measured for the user, such as personalizing models to amplify recognized voices and to determine filters suitable for the most frequently observed background noises; etc.) for different users (e.g., on a monthly basis). In another example, reference audio profiles (e.g., indicating types of voices and background noises, etc.; generated based on audio data from other users, generic models, or otherwise generated) can be applied for a user (e.g., in determining audio-related parameters for the user; in selecting target audio data; etc.) based on one or more of: location (e.g., generating a reference audio profile for filtering background noises commonly observed at a specific location; etc.), communication parameters (e.g., signal strength, communication signatures; etc.), time, user orientation, user movement, other contextual situation parameters (e.g., number of distinct voices, etc.), and/or any other suitable criteria.

The remote computing system 230 can be configured to receive data from a tertiary system, a supplementary component (e.g., a docking station; a charging station; etc.), an earpiece, and/or any other suitable components. The remote computing system 230 can be further configured to receive and/or otherwise process data (e.g., update models, such as based on data collected for a plurality of users over a recent time interval, etc.) at predetermined time intervals (e.g., hourly, daily, weekly, etc.), in temporal relation to trigger conditions (e.g., in response to connection of the tertiary system and/or earpiece to a docking station; in response to collecting a threshold amount and/or types of data; etc.), and/or at any suitable time and frequency. In an example, a remote computing system 230 can be configured to: receive audio-related data from a plurality of users through tertiary systems associated with the plurality of users; update models; and transmit the updated models to the tertiary systems for subsequent use (e.g., updated audio parameter models for use by the tertiary system; updated target audio selection models that can be transmitted from the tertiary system to the ear piece; etc.). Additionally or alternatively, the remote computing system 230 can facilitate updating of any suitable models (e.g., target audio selection models, audio parameters models, other models described herein, etc.) for application by any suitable components (e.g., collective updating of models transmitted to earpieces associated with a plurality of users; collective updating of models transmitted to tertiary systems associated with a plurality of users, etc.). In some embodiments, collective updating of models can be tailored to individual users (e.g., where users can set preferences for update timing and frequency etc.), subgroups of users (e.g., varying model updating parameters based on user conditions, user demographics, other user characteristics), device type (e.g., earpiece version, tertiary system version, sensor types associated with the device, etc.), and/or other suitable aspects. For example, models can be additionally or alternatively improved with user data (e.g., specific to the user, to a user account, etc.) that can facilitate users-specific improvements based on voices, sounds, experiences, and/or other aspects of use and audio environmental factors specific to the user which can be incorporated into the user specific model, where the updated model can be transmitted back to the user (e.g., to a tertiary unit, earpiece, and/or other suitable component associated with the user, etc.). Collective updating of models described herein can confer improvements to audio enhancement, personalization of audio provision to individual users, audio-related modeling in the context of enhancing playback of audio (e.g., in relation to quality, latency, processing, etc.), and/or other suitable aspects. Additionally or alternatively, updating and/or otherwise processing models can be performed at one or more: tertiary systems, earpieces, user devices, and/or other suitable components. However, remote computing systems 230 can be configured in any suitable manner.

In some embodiments, a remote computing system 230 includes one or more models and/or algorithms (e.g., machine learning models and algorithms, algorithms implemented at the tertiary system, etc.), which are trained on data from one or more of an earpiece, tertiary system, and user device. In a specific example, for instance, data (e.g., audio data, raw audio data, audio parameters, filter parameters, transmission parameters, etc.) are transmitted to a remote computing system, where the data is analyzed and used to implement one or more processing algorithms of the tertiary system and/or earpiece. These data can be received from a single user, aggregated from multiple users, or otherwise received and/or determined. In a specific example, the system transmits (e.g., regularly, routinely, continuously, at a suitable trigger, with a predetermined frequency, etc.) audio data to the remote computing system (e.g., cloud) for training and receives updates (e.g., live updates) of the model back (e.g., regularly, routinely, continuously, at a suitable trigger, with a predetermined frequency, etc.).

4.4 User Device

In the illustrate embodiment, system 200 can includes one or more user devices 240, which can function to interface (e.g., communicate with) one or more other components of the system 200, receive user inputs, provide one or more outputs, or perform any other suitable function, The user device preferably includes a client; additionally or alternatively, a client can be run on another component (e.g., tertiary system) of the system 200. The client can be a native application, a browser application, an operating system application, or be any other suitable application or executable.

Examples of the user device 240 can include a tablet, smartphone, mobile phone, laptop, watch, wearable device (e.g., glasses), or any other suitable user device. The user device can include power storage (e.g., a battery), processing systems (e.g., CPU, GPU, memory, etc.), user outputs (e.g., display, speaker, vibration mechanism, etc.), user inputs (e.g., a keyboard, touchscreen, microphone, etc.), a location system (e.g., a GPS system), sensors (e.g., optical sensors, such as light sensors and cameras, orientation sensors, such as accelerometers, gyroscopes, and altimeters, audio sensors, such as microphones, etc.), data communication system (e.g., a Wi-Fi module, BLE, cellular module, etc.), or any other suitable component.

Outputs can include: displays (e.g., LED display, OLED display, LCD, etc.), audio speakers, lights (e.g., LEDs), tactile outputs (e.g., a tixel system, vibratory motors, etc.), or any other suitable output. Inputs can include: touchscreens (e.g., capacitive, resistive, etc.), a mouse, a keyboard, a motion sensor, a microphone, a biometric input, a camera, or any other suitable input.

4.5 Supplementary Sensors

The system 200 can include one or more supplementary sensors (not shown), which can function to provide a contextual dataset, locate a sound source, locate a user, or perform any other suitable function. Supplementary sensors can include any or all of: cameras (e.g., visual range, multispectral, hyperspectral, IR, stereoscopic, etc.), orientation sensors (e.g., accelerometers, gyroscopes, altimeters), acoustic sensors (e.g., microphones), optical sensors (e.g., photodiodes, etc.), temperature sensors, pressure sensors, flow sensors, vibration sensors, proximity sensors, chemical sensors, electromagnetic sensors, force sensors, or any other suitable type of sensor.

5. Another Alternative Embodiment

Figure 5:
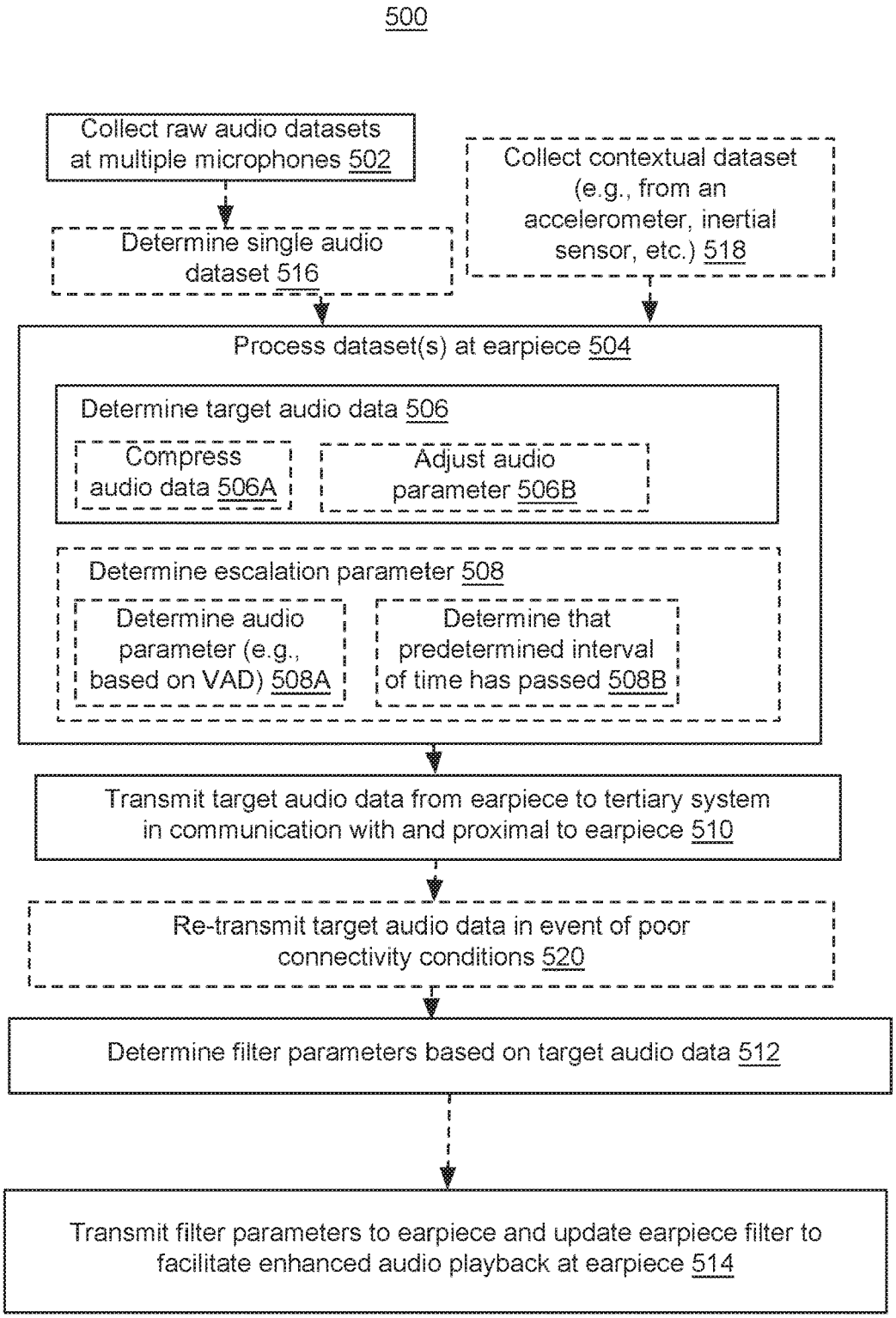
FIG. 5 is a flow diagram illustrating a method in accordance with an alternative embodiment of the invention.

FIG. 5 illustrates method/processing 500 which is an alternative embodiment to method 100. At Block 502, one or more raw audio datasets are collected at multiple microphones, such as at each of a set of earpiece microphones (e.g., microphone(s) 212 of earpiece 210). At Block 504, the one or more datasets are processed at the earpiece. In some embodiments, one or more raw audio datasets, processed audio datasets and/or single audio datasets may be processed. As shown in Block 506, the processing may include determining target audio data, e.g., in response to the satisfaction of an escalation parameter, by compressing audio data (506A), adjusting an audio parameter such as bit depth (506B) and/or one or more other operations. Further, as shown in Block 508, the processing may include determining an escalation parameter by, for example, determining an audio parameter, e.g., based on voice activity detection (508A), determining that a predetermined time interval has passed (508B) and/or one or more other operations.

At Block 510, the target audio data is transmitted from the earpiece to a tertiary system in communication with and proximal to the earpiece, and filter parameters are determined based on the target audio data at Block 512. For example, the tertiary system (e.g., tertiary system 220) may be configured to determine the filter parameters by, for example, determining a set of per frequency coefficients, determining a Wiener filter, or by using one or more other operations. At Block 514, the filter parameters are transmitted (e.g., wirelessly by tertiary system 220) to the earpiece to update at least one filter at the earpiece and facilitate enhanced audio playback at the earpiece.

In some embodiments, method/processing 500 may include one or more additional steps. For example, as shown at Block 516, a single audio dataset (e.g., a beamformed single audio time-series) may be determined based on the raw audio data received at the multiple microphones. Further, as shown at Block 518, a contextual dataset may be collected (e.g., from an accelerometer, inertial sensor, etc.) to locate a sound source, escalate target audio data to the tertiary system, detect poor connectivity/handling conditions that exist between the earpiece and tertiary system, etc. For example, the contextual dataset may be used to determine whether multiple instances of target audio data should be transmitted/retransmitted from the earpiece to the tertiary system in the event of poor connectivity/handling conditions, as shown at Block 520.

Thus, in a specific embodiment, method/processing 500 may comprise one or more of collecting audio data at an earpiece (Block 502); determining that a set of frequencies corresponding to human voice is present, e.g., at a volume above a predetermined threshold (Block 504); transmitting target audio data (e.g., beamformed audio data) from the earpiece to the tertiary system (Block 510); determining a set of filter coefficients which preserve and/or amplify (e.g., not remove, amplify, etc.) sound corresponding to the voice frequencies and minimize or remove other frequencies (e.g., background noise) (Block 512); and transmitting the filter coefficients to the earpiece to facilitate enhanced audio playback by updating a filter at the earpiece with the filter coefficients and filtering subsequent audio received at the earpiece with the updated filter (Block 514).

6. Additional Embodiments

A first embodiment of a method for providing enhanced audio at an earpiece comprising a set of microphones and implementing an audio filter for audio playback, the method comprising: receiving, at the set of microphones, a first audio dataset at a first time point, the first audio dataset comprising a first audio signal; processing the first audio signal to determine an escalation parameter; comparing the escalation parameter with a predetermined escalation threshold; in response to determining that the escalation parameter exceeds the predetermined threshold: transmitting the first audio signal to a tertiary system separate and distinct from the earpiece; determining a set of filter coefficients at the tertiary system based on the first audio signal and transmitting the set of filter frequency coefficients to the earpiece; updating the audio filter at the earpiece with the set of filter frequency coefficients; receiving a second audio dataset at the earpiece at a second time point; processing the second audio dataset with the audio filter, thereby producing an altered audio dataset; and playing the altered audio dataset at a speaker of the earpiece.

A second embodiment comprising the first embodiment, wherein determining the escalation parameter comprises processing the first audio signal with a voice activity detection algorithm to determine an audio parameter.

A third embodiment comprising the second embodiment wherein the audio parameter comprises an amplitude of a frequency distribution corresponding to human voice.

A fourth embodiment comprising the first embodiment wherein determining the escalation parameter comprises determining an amount of time that has passed since the audio filter had been last updated.

A fifth embodiment comprising the first embodiment wherein each of the earpieces comprises two microphones, and wherein the first audio signal is determined based on a beamforming protocol, wherein the first audio signal comprises a single audio time-series based on audio data received at the two microphones.

A sixth embodiment comprising the first embodiment and further comprising receiving an input at an application executing on a user device, the user device separate and distinct from both the earpiece and the tertiary device, wherein the set of filter parameters are further determined based on the input.

A seventh embodiment comprising the first embodiment and further comprising transmitting a lifetime of the set of filter coefficients from the tertiary system to the earpiece.

An eighth embodiment comprising the seventh embodiment and further comprising further updating the filter with a cached filter stored at the earpiece after the lifetime of the set of filter frequency coefficients has passed.

7. Combinations, Systems, Methods, and Computer Program Products

Although omitted for conciseness, the embodiments include suitable combinations and permutations of the various system components and the various method processes, including variations, examples, and specific examples, where the method processes can be performed in any suitable order, sequentially or concurrently using any suitable system components. The system and method and embodiments thereof can be embodied and/or implemented at least in part as a machine configured to receive a computer-readable medium storing computer-readable instructions. The instructions are preferably executed by computer-executable components preferably integrated with the system. The computer-readable medium can be stored on any suitable computer-readable media such as RAMs, ROMs, flash memory, EEPROMs, optical devices (CD or DVD), hard drives, floppy drives, or any suitable device. Preferably, the computer-readable medium is non-transitory. However, in alternatives, it is transitory. The computer-executable component is preferably a general or application specific processor, but any suitable dedicated hardware or hardware/firmware combination device can alternatively or additionally execute the instructions. As a person skilled in the art will recognize from the previous detailed description and from the figures and claims, modifications and changes can be made to the embodiments without departing from the scope defined in the following claims.

We claim:

1. A method for providing enhanced audio at an earpiece, the earpiece comprising a set of microphones and being configured to implement an audio filter for audio playback, the method comprising:

collecting, at the set of microphones, audio datasets;

processing, at the earpiece, the audio datasets to obtain target audio data;

wirelessly transmitting, at one or more first selected time intervals, data representing the target audio data from the earpiece to an auxiliary processing unit;

determining, at the auxiliary processing unit, a set of filter parameters based on the data representing the target audio data and wirelessly transmitting the set of filter parameters from the auxiliary processing unit to the earpiece;

updating the audio filter at the earpiece based on the set of filter parameters to provide an updated audio filter wherein filter parameters are: determined at the auxiliary processing unit, wirelessly transmitted from the auxiliary processing unit to the earpiece, and used to update the audio filter at the earpiece at an update rate that is greater than once every 500 milliseconds during a time period when voice activity is detected to be present;

using the updated audio filter to produce enhanced audio; and playing the enhanced audio at the earpiece.

2. The method of claim 1, wherein the data representing the target audio data is derived from the target audio data.

3. The method of claim 1, wherein the data representing the target audio data comprises the target audio data.

4. The method of claim 1, wherein the target audio data comprises a selected subset of the audio datasets.

5. The method of claim 1, wherein the data representing the target audio data comprises features of the target audio data.

6. The method of claim 1, wherein the data representing the target audio data is compressed at the earpiece prior to transmission to the auxiliary processing unit.

7. The method of claim 1 wherein the data representing the target audio data is wirelessly transmitted from the earpiece to the auxiliary processing unit at the one or more first selected time intervals after determining that a trigger condition has occurred.

8. The method of claim 7 wherein determining that the trigger condition has occurred is based on processing of the audio data sets.

9. The method of claim 8, wherein determining that the trigger condition has occurred comprises using a voice activity detection parameter in conjunction with one or more other parameters.

10. The method of claim 9, wherein the voice activity detection parameter comprises an amplitude of a frequency distribution corresponding to human voice.

11. The method of claim 1, wherein the audio filter is a frequency-domain filter.

12. The method of claim 1, wherein the audio filter comprises a time-domain filter and the set of filter parameters include time-domain filter coefficients.

13. The method of claim 12 wherein the audio filter is a finite impulse response filter.

14. The method of claim 12 wherein the audio filter is an infinite impulse response filter.

15. The method of claim 1, wherein the first selected time intervals are less than 400 milliseconds.

16. The method of claim 1, wherein the first selected time intervals are less than 100 milliseconds.

17. The method of claim 1, wherein the first selected intervals of time are less than 20 milliseconds.

18. The method of claim 1, wherein the auxiliary processing unit comprises a set of antennas, and wherein the method further comprises determining a primary antenna from the set of antennas, wherein the primary antenna receives a highest signal strength of the target audio signal, and wherein the set of filter parameters are transmitted to the earpiece from the primary antenna.

19. The method of claim 1, further comprising applying a beamforming protocol to obtain at least one of the target audio data and the data representing the target audio data.

20. The method of claim 1, further comprising receiving input at an application executing on a user device communicatively coupled with the auxiliary processing unit wherein the set of filter parameters are further determined based on the input.

21. The method of claim 1, further comprising transmitting a lifetime of the set of filter parameters from the auxiliary processing unit to the earpiece.

22. The method of claim 21, further comprising updating the audio filter with cached filter parameters after the lifetime of the set of filter parameters has passed.

23. The method of claim 21, further comprising updating the audio filter with filter parameters computed at the earpiece.

24. The method of claim 1 wherein wirelessly transmitting the set of filter parameters from the auxiliary processing unit to the earpiece is done at one or more second selected time intervals.

25. The method of claim 24 wherein the second selected time intervals are longer than the first selected time intervals.

26. The method of claim 24 wherein the second selected time intervals are different from the first selected time intervals.

27. An auxiliary processing device for supporting low-latency audio enhancement at a hearing aid over a wireless communications link, the auxiliary processing device comprising:

a processor configured to execute, based on a filter update rate that is more than once every 500 milliseconds when voice activity has been detected, processing comprising analyzing first data corresponding to target audio wirelessly received by the auxiliary processing device from a hearing aid earpiece and, based on the analyzing, determining filter parameters for enhancing the audio; and a wireless link configured to receive the first data and to transmit the determined filter parameters to the hearing aid earpiece.

28. A hearing aid earpiece comprising:

one or more microphones;

a processor configured to execute processing to determine target audio data from audio datasets collected by the one or more microphones, the target audio being selected for wireless transmission to an auxiliary processing unit to identify filter parameters for enhancement of the target audio; and a wireless link adapted for sending data representing the target audio to the auxiliary processing unit and for receiving the identified filter parameters from the auxiliary processing unit wherein the processor is further configured to update an audio filter at the earpiece based on identified filter parameters wirelessly transmitted from the auxiliary processing unit to the earpiece at an update rate that is more than once every 500 milliseconds during a time period when voice activity is detected to be present, and wherein the processor is further configured to use the updated audio filter to produce enhanced audio at the earpiece.

29. The method of claim 1 wherein the update rate is an average rate.

30. The auxiliary processing device of claim 27 wherein the update rate is an average rate.

31. The hearing aid earpiece of claim 28 wherein the update rate is an average rate.

32. The hearing aid earpiece of claim 28 wherein the earpiece is configured to send target audio to the auxiliary processing unit for identifying filter parameters at time intervals of less than 100 milliseconds.

33. The hearing aid earpiece of claim 28 wherein the earpiece is configured to send target audio to the auxiliary processing unit for identifying filter parameters at time intervals of less than 20 milliseconds.

34. The hearing aid earpiece of claim 28, wherein the identified filter parameters have a designated lifetime and wherein the processor is further configured to update the audio filter with cached filter parameters after the designated lifetime of the identified filter parameters has passed.

35. The auxiliary processing device of claim 27 wherein the processor is configured to identify filter parameters from target audio that is received at time intervals of less than 100 milliseconds.

36. The auxiliary processing device of claim 27 wherein the wherein the processor is configured to identify filter parameters from target audio that is received at time intervals of less than 20 milliseconds.

37. The auxiliary processing device of claim 27 wherein the processor is further configured to determine the filter parameters using user input obtained from an application executing on a user device communicatively coupled with the auxiliary processing device.

* * * * *